US009545800B2

(12) United States Patent
Murata

(10) Patent No.: US 9,545,800 B2
(45) Date of Patent: Jan. 17, 2017

(54) PRINTING UNIT AND THERMAL PRINTER

(71) Applicant: Seiko Instruments Inc., Chiba-shi, Chiba (JP)

(72) Inventor: Tomohiro Murata, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 14/974,914

(22) Filed: Dec. 18, 2015

(65) Prior Publication Data

US 2016/0185141 A1 Jun. 30, 2016

(30) Foreign Application Priority Data

Dec. 25, 2014 (JP) ..... 2014-262942
Jun. 30, 2015 (JP) ..... 2015-131487

(51) Int. Cl.
*B41J 15/04* (2006.01)
*B41J 11/70* (2006.01)
(Continued)

(52) U.S. Cl.
CPC ..... *B41J 11/70* (2013.01); *B26D 1/065* (2013.01); *B41J 2/32* (2013.01); *B41J 11/703* (2013.01);
(Continued)

(58) Field of Classification Search
CPC ..... B41J 2/32; B41J 11/00; B41J 13/00; B41J 15/00; B41J 2202/31; B41J 11/70; B41J 11/703; B41J 15/042; B41J 25/312; B26D 1/065
See application file for complete search history.

(56) References Cited

U.S. PATENT DOCUMENTS 5,565,905 A * 10/1996 Kajiya ..... B41J 13/10 347/197
2002/0056354 A1 5/2002 Morita et al.
(Continued)

FOREIGN PATENT DOCUMENTS

EP 1 955 833 A1 8/2008
EP 2 343 166 A1 7/2011
JP 2006-312321 A 11/2006

OTHER PUBLICATIONS

Extended European Search Report for corresponding European Application No. 15202439.4, dated May 11, 2016, 11 pages.

*Primary Examiner* — Julian Huffman
*Assistant Examiner* — Sharon A Polk
(74) *Attorney, Agent, or Firm* — Brinks Gilson & Lione

(57) ABSTRACT

A printing unit comprises: a platen unit including a platen roller configured to feed a recording sheet; and a head unit including a thermal head configured to perform printing on the recording sheet, the head unit being separably combined with the platen unit, the head unit including: a head frame; a cutter mechanism mounted to the head frame in a removable manner, the cutter mechanism being configured to cut the recording sheet; a support member provided between the cutter mechanism and the head frame, the support member being movable between a coupled position at which the cutter mechanism is coupled to the head frame and a decoupled position at which the cutter mechanism is detachable from the head frame; and a first urging member interposed between the thermal head and the support member, the first urging member being configured to urge the thermal head toward the platen roller, and to urge the support member toward the coupled position.

7 Claims, 22 Drawing Sheets

(51) Int. Cl.
*B41J 2/32* (2006.01)
*B41J 25/312* (2006.01)
*B26D 1/06* (2006.01)

(52) U.S. Cl.
CPC ..... *B41J 15/042* (2013.01); *B41J 25/312* (2013.01); *B41J 2202/31* (2013.01)

(56) References Cited

U.S. PATENT DOCUMENTS

| | | | | |
|---|---|---|---|---|
| 2004/0037606 | A1 | 2/2004 | Tsuchiya et al. | |
| 2004/0096256 | A1 | 5/2004 | Hayashi et al. | |
| 2004/0184863 | A1* | 9/2004 | Mori | B26D 1/085 400/621 |
| 2006/0088360 | A1 | 4/2006 | Watanabe et al. | |
| 2007/0091162 | A1* | 4/2007 | Takabatake | B41J 2/32 347/220 |
| 2009/0219375 | A1* | 9/2009 | Trauer | B41J 15/042 347/197 |
| 2012/0050446 | A1* | 3/2012 | Tsuchiya | B41J 2/325 347/197 |

* cited by examiner

PRINTING UNIT AND THERMAL PRINTER

RELATED APPLICATIONS

This application claims priority under 35 U.S.C. §119 to Japanese Patent Applications No. 2014-262942 filed on Dec. 25, 2014 and No. 2015-131487 filed on Jun. 30, 2015, the entire content of which are hereby incorporated by reference.

BACKGROUND OF THE INVENTION

1. Field of the Invention

The present invention relates to a printing unit and a thermal printer.

2. Description of the Related Art

Hitherto, a thermal printer has been known as a printer configured to perform printing on a recording sheet (heat-sensitive paper). The thermal printer includes a printing unit that can be reduced in size and weight, and has a simple configuration without using toner or ink. Therefore, the thermal printer is employed for cash registers or mobile terminal devices to be widely used to print various labels, receipts, and tickets.

As the printing unit described above, a so-called "separate-type" printing unit is known. In the separate-type printing unit, for example, a head frame configured to support a thermal head is mounted to a casing main body configured to receive, for example, a roll sheet therein, whereas a platen frame configured to support a platen roller is mounted to a printer cover that is coupled to the casing main body so that the printer cover can be operated to be opened and closed.

Further, a printing unit including a cutter unit configured to cut a printed recording sheet is known. The cutter unit includes a movable blade incorporated into, for example, the head frame of the above-mentioned frames, and a fixed blade incorporated into, for example, the platen frame of the above-mentioned frames. According to this configuration, the movable blade is slid relative to the fixed blade so as to nip the recording sheet between the movable blade and the fixed blade, to thereby cut the recording sheet.

Incidentally, in the printing unit, the thermal head may be replaced when a failure occurs in the thermal head due to wear between the thermal head and the platen roller or the like. As a method for replacing the thermal head, there is conceivable a method involving removing the movable blade from the head frame first, and removing the thermal head from the head frame thereafter. However, in the above-mentioned related-art configuration, the movable blade is fixed to the head frame with fastening members such as screws. Therefore, tools are necessary for the work of mounting and removing the movable blade, resulting in a problem of low maintainability. Further, in order to mount the movable blade, the above-mentioned fastening members are additionally necessary, resulting in a fear of the increase in number of components and manufacturing cost.

In view of the above-mentioned matters, a printing unit and a thermal printer capable of enhancing the maintainability while suppressing the increase in number of components and achieving cost reduction are demanded in this technical field.

SUMMARY OF THE INVENTION

According to one embodiment of the present invention, there is provided a printing unit, including: a platen unit including a platen roller configured to feed a recording sheet; and a head unit including a thermal head configured to perform printing on the recording sheet, the head unit being separably combined with the platen unit, the head unit including: a head frame; a cutter mechanism mounted to the head frame in a removable manner, the cutter mechanism being configured to cut the recording sheet; a support member provided between the cutter mechanism and the head frame, the support member being movable between a coupled position at which the cutter mechanism is coupled to the head frame and a decoupled position at which the cutter mechanism is detachable from the head frame; and a first urging member interposed between the thermal head and the support member, the first urging member being configured to urge the thermal head toward the platen roller, and to urge the support member toward the coupled position.

According to this configuration, the support member is urged toward the coupled position by the first urging member. Therefore, the state in which the cutter mechanism and the head frame are coupled to each other may be maintained by the support member interposed therebetween. On the other hand, for removal of the cutter mechanism, the cutter mechanism and the head frame, which are coupled through intermediation of the support member, may be easily decoupled from each other only by moving the support member toward the decoupled position. With this, for example, an operator may easily move on to work of replacing the thermal head, which is carried out thereafter, thereby being capable of reducing a time period required for maintenance. Further, unlike the related-art case where the cutter mechanism and the head frame are coupled to each other with fastening members such as screws, tools are not required to be used for work of mounting and removing the cutter mechanism. Therefore, the maintainability may be enhanced. In particular, according to the configuration of the present invention, the support member is urged toward the coupled position by the first urging member configured to urge the thermal head toward the platen roller. Therefore, both the operations of pressurizing the head and urging the support member may be performed by the first urging member. With this, as compared to a case where the operations of pressurizing the head and urging the support member are performed by different urging members, the increase in number of components may be suppressed to achieve cost reduction.

In the printing unit according to the one embodiment of the present invention, the thermal head is mounted to the head frame in a removable manner. According to this configuration, the work of mounting and removing the cutter mechanism may be easily carried out. Therefore, the work of replacing the thermal head may be easily carried out as a whole.

In the printing unit according to the one embodiment of the present invention, the support member is slidable along an urging direction of the first urging member. According to this configuration, the support member is slidable along the urging direction of the first urging member. Therefore, for example, as compared to a case where the support member is moved through pivot or the like, an amount of displacement between the coupled position and the decoupled position may be reduced. With this, the printing unit may be reduced in size and the layout efficiency may be enhanced.

In the printing unit according to the one embodiment of the present invention, the cutter mechanism includes: a support member fixing piece, which is locked to the support member when the support member is located at the coupled position; and a frame fixing piece, which is inserted into the head frame. According to this configuration, the cutter mechanism is locked to the support member at the support member fixing piece, and is inserted into the head frame at the frame fixing piece. Therefore, the cutter mechanism is coupled to both the head frame and the support member. Accordingly, the cutter mechanism may be mounted to the head frame at a desired position.

The printing unit according to the one embodiment of the present invention further includes a second urging member configured to urge the cutter mechanism in a direction of detaching the cutter mechanism from the head frame. According to this configuration, the printing unit further includes the second urging member configured to urge the cutter mechanism in the direction of detaching the cutter mechanism from the head frame. Therefore, when the support member is located at the decoupled position, the cutter mechanism is automatically detached from the support member. Accordingly, the cutter mechanism may be detached from the support member only through a single operation of pushing the support member to the decoupled position without time and effort in detaching the cutter mechanism from the support member under a state in which the support member is pushed to the decoupled position or the like. With this, the maintainability may be further enhanced.

In the printing unit according to the one embodiment of the present invention, the support member is formed of a metal material. The cutter mechanism includes a motor configured to drive a movable blade. At least a part of the motor is exposed from a surface of the cutter mechanism, which is opposed to the support member. The second urging member is formed of a conductive material, and is provided under a state in which the second urging member comes into contact with the support member and the motor. According to this configuration, electrical conduction of the motor for a movable blade is ensured by the above-mentioned second urging member. As a result, the reliability of the motor for a movable blade may be enhanced without additionally providing a new member.

According to one embodiment of the present invention, there is provided a printer, including: the printing unit described above; and a casing having the printing unit assembled therein. According to this configuration, the printer includes the printing unit according to the present invention. Therefore, a thermal printer excellent in maintainability may be provided.

As described above, according to the printing unit and the thermal printer of the one embodiment of the present invention, the maintainability may be enhanced while suppressing the increase in number of components and achieving the cost reduction.

DETAILED DESCRIPTION OF THE PREFERRED EMBODIMENTS

Embodiments of the present invention are now described referring to the accompanying drawings.

Figure 1:
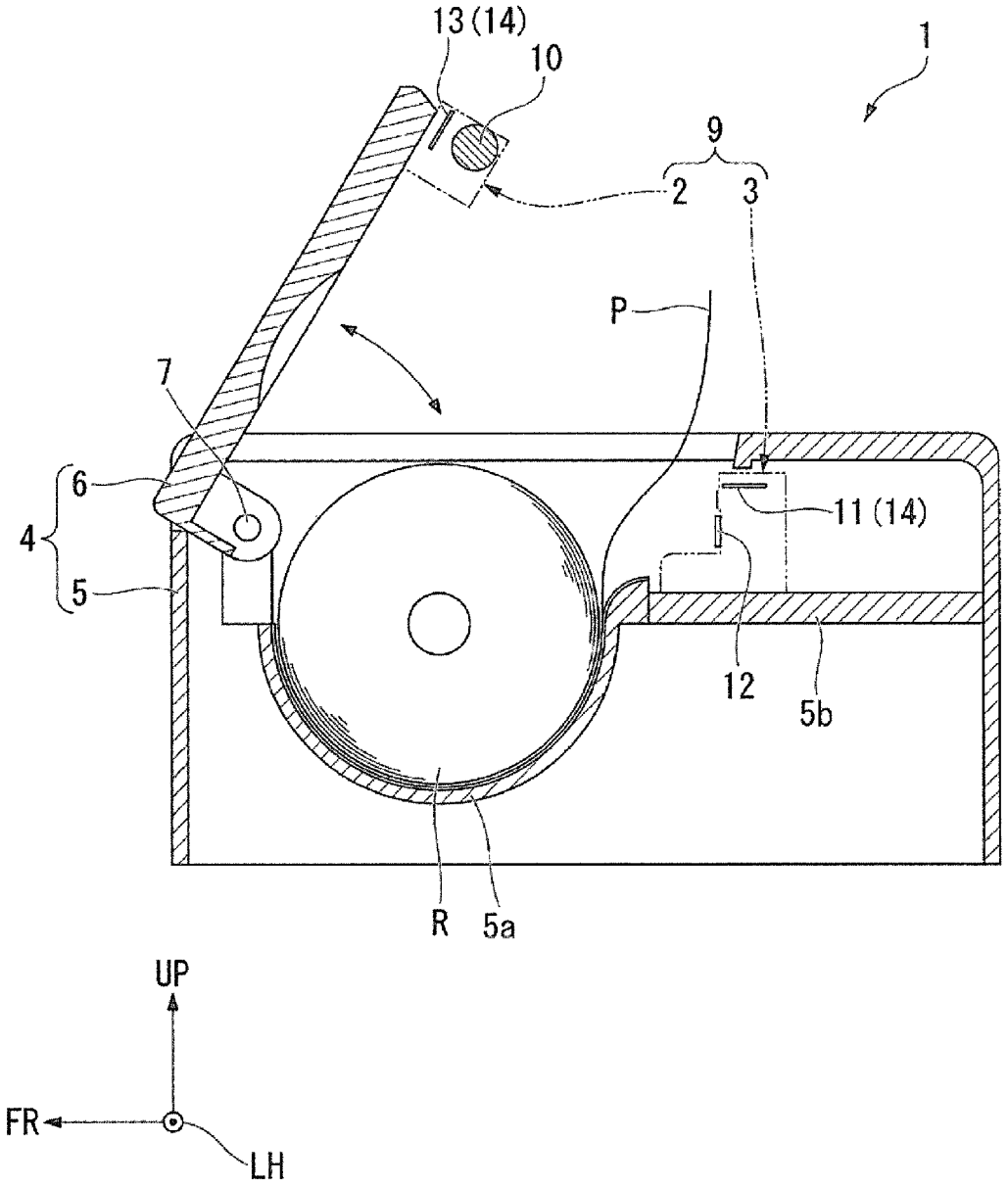
FIG. 1 is a sectional view of a thermal printer, for illustrating a state in which a printer cover is located at an opened position.
Figure 2:
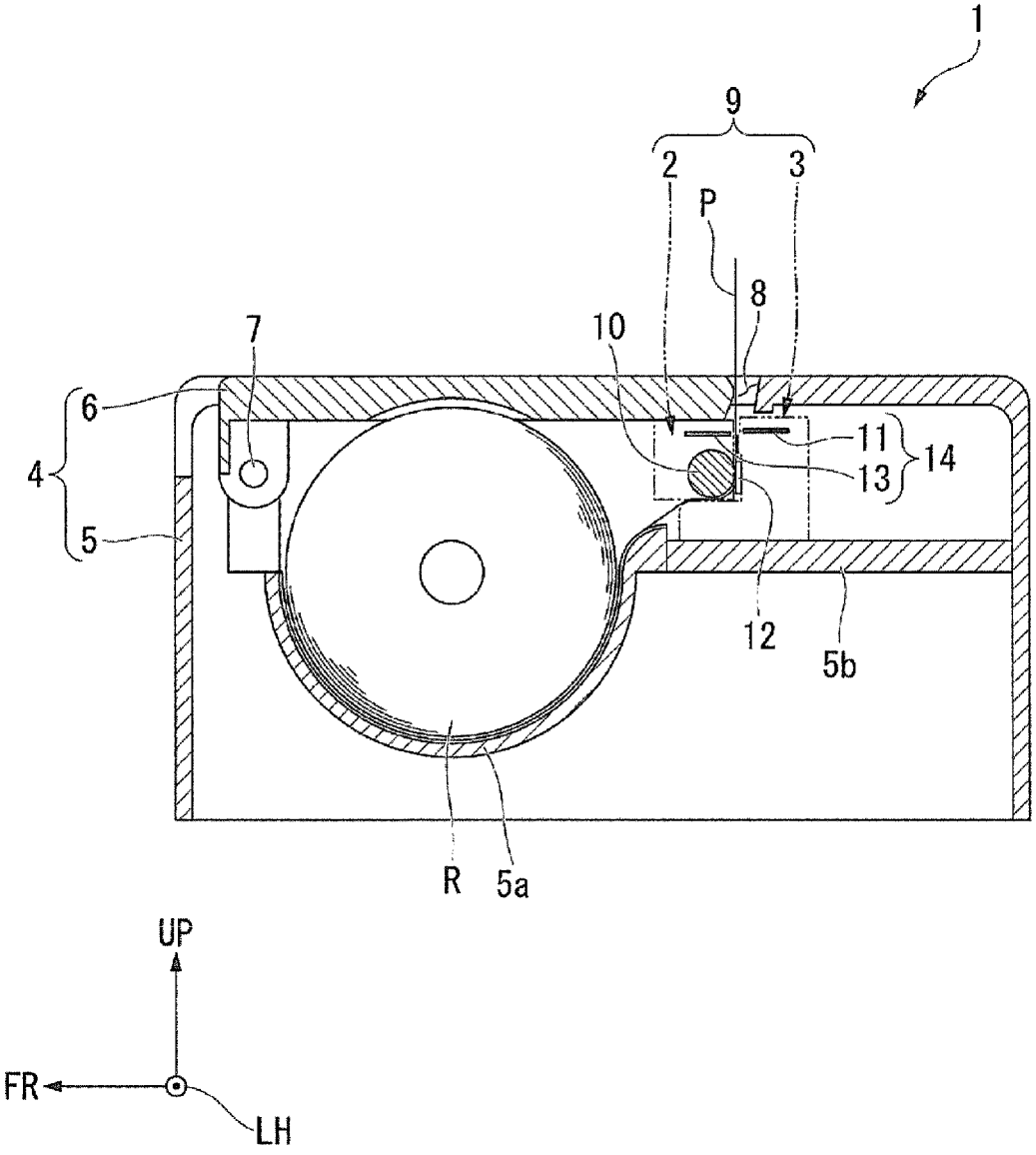
FIG. 2 is a sectional view of the thermal printer, for illustrating a state in which the printer cover is located at a closed position.

FIG. 1 and FIG. 2 are sectional views of a thermal printer 1. FIG. 1 is an illustration of a state in which a printer cover 6 is located at an opened position, whereas FIG. 2 is an illustration of a state in which the printer cover 6 is located at a closed position. In the drawings, FR represents a forward direction, LH represents a leftward direction, and UP represents an upward direction. As illustrated in FIG. 1 and FIG. 2, the thermal printer 1 of this embodiment includes a printing unit 9 and a casing 4. The printing unit 9 includes a platen unit 2 and a head unit 3, which are combined with each other separably. The printing unit 9 is incorporated into the casing 4 that also receives a roll sheet R obtained by rolling a recording sheet P therein.

The casing 4 includes a casing main body 5 and the printer cover 6. The casing main body 5 includes a roll sheet receiving portion 5*a* configured to receive the roll sheet R therein. The printer cover 6 opens and closes the roll sheet receiving portion 5*a*. The printer cover 6 is coupled pivotally to the casing main body 5 through intermediation of a hinge portion 7. Further, as illustrated in FIG. 2, a discharge port 8 for discharging the recording sheet P externally (upward) is formed between an opening edge of the roll sheet receiving portion 5*a* and a distal end portion of the printer cover 6 when the printer cover 6 is located at the closed position.

The platen unit 2 described above is a unit having a platen roller 10 and a fixed blade 13 mainly incorporated therein, and is mounted to an inner surface of a distal end portion of the printer cover 6. Therefore, through movement along with an opening and closing operation of the printer cover 6, the platen unit 2 is separably combined with the head unit 3. On the other hand, the head unit 3 is, for example, a unit having a thermal head 12 and a movable blade (cutter mechanism) 11 mainly incorporated therein, and is mounted to the casing main body 5. In the illustrated example, the head unit 3 is fixed on an inner plate 5*b* provided so as to be adjacent to the roll sheet receiving portion 5*a* so that the thermal head 12 is oriented toward the roll sheet receiving portion 5*a*.

When the printer cover 6 is closed to combine the platen unit 2 and the head unit 3 with each other, the thermal head 12 is pressed against the platen roller 10, as illustrated in FIG. 2. At the same time, the movable blade 11 and the fixed blade 13 are located at a predetermined position. The fixed blade 13 and the movable blade 11 form a cutter unit 14.

Figure 3:
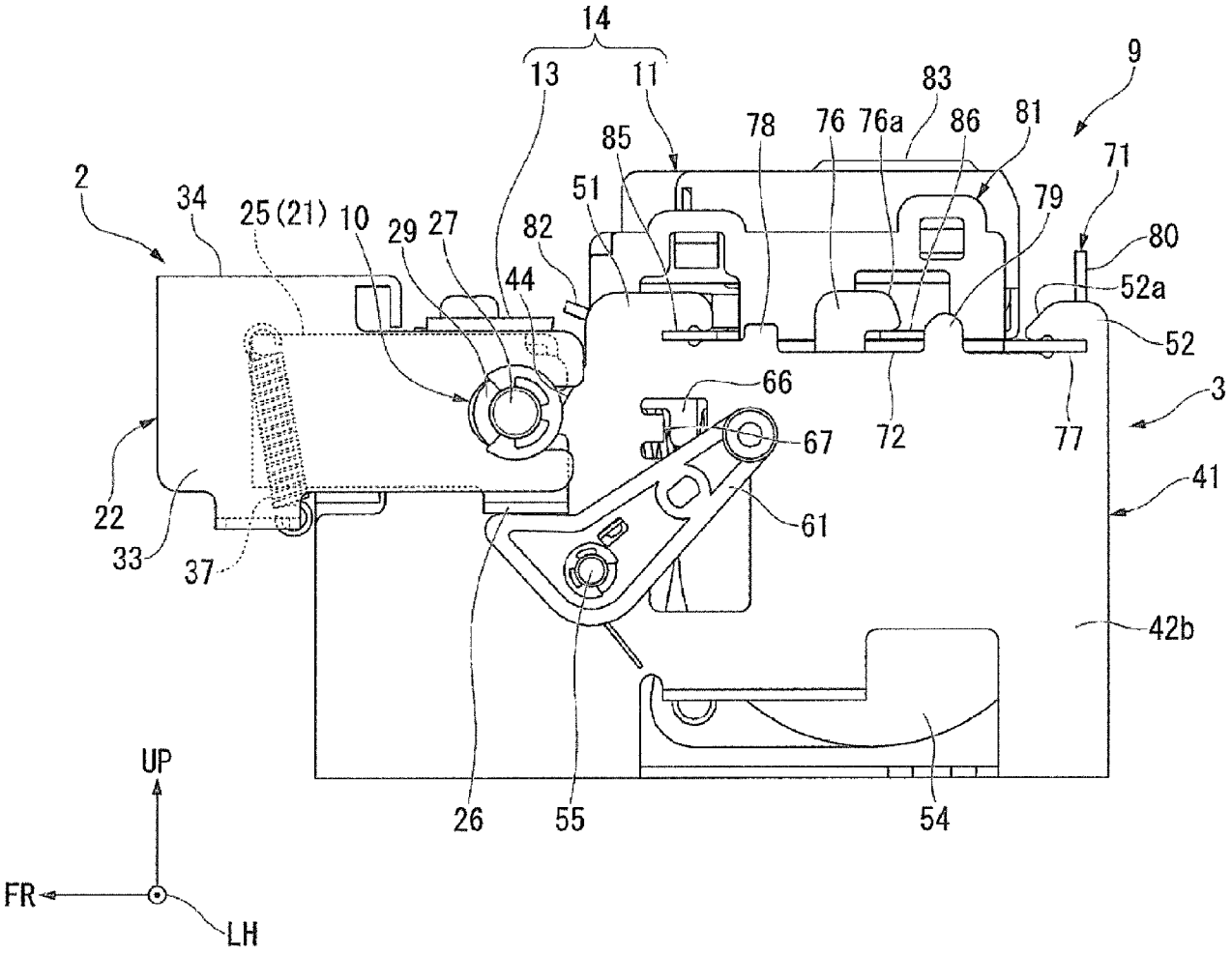
FIG. 3 is a side view of a printing unit.
Figure 4:
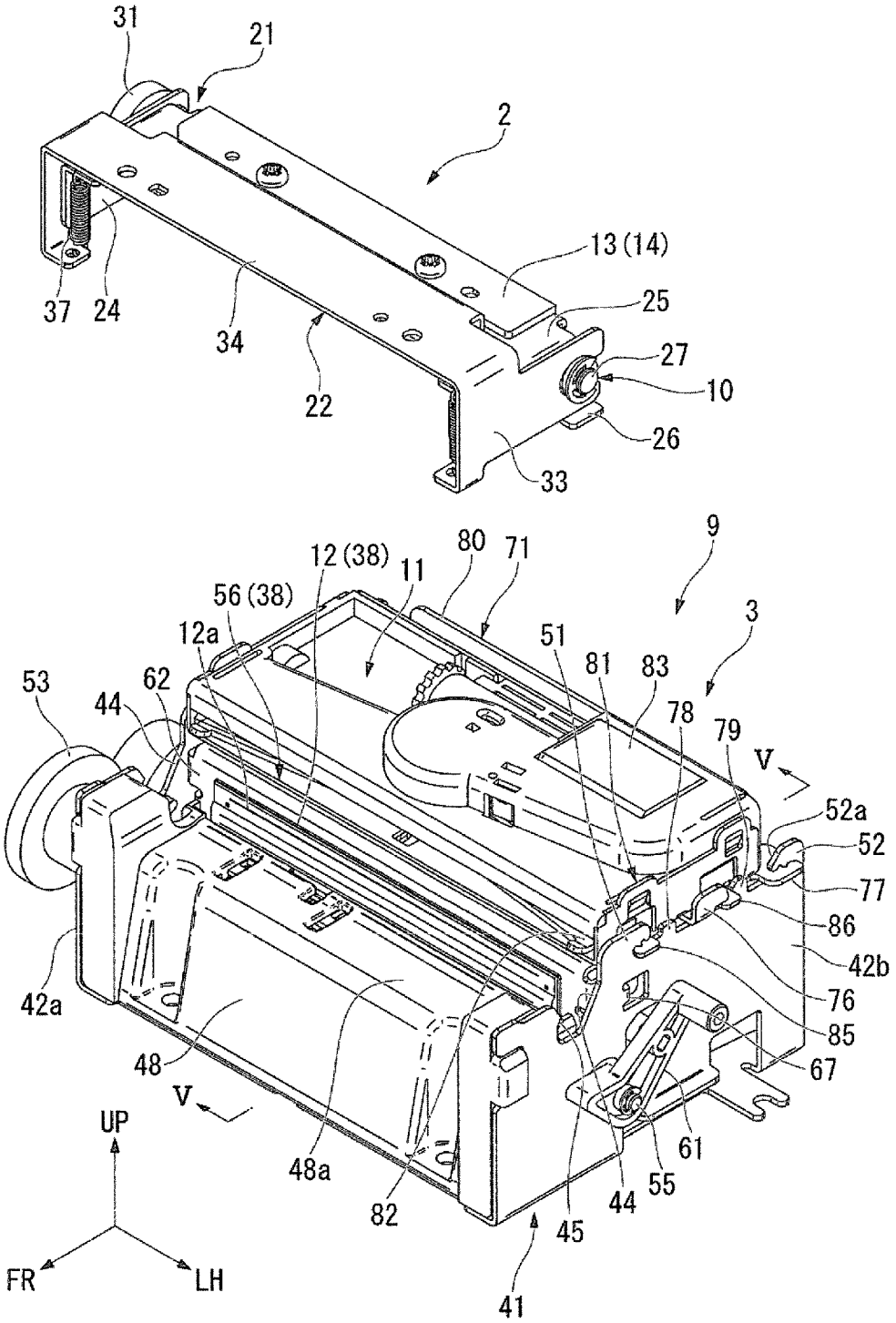
FIG. 4 is an exploded perspective view of the printing unit.
Figure 5:
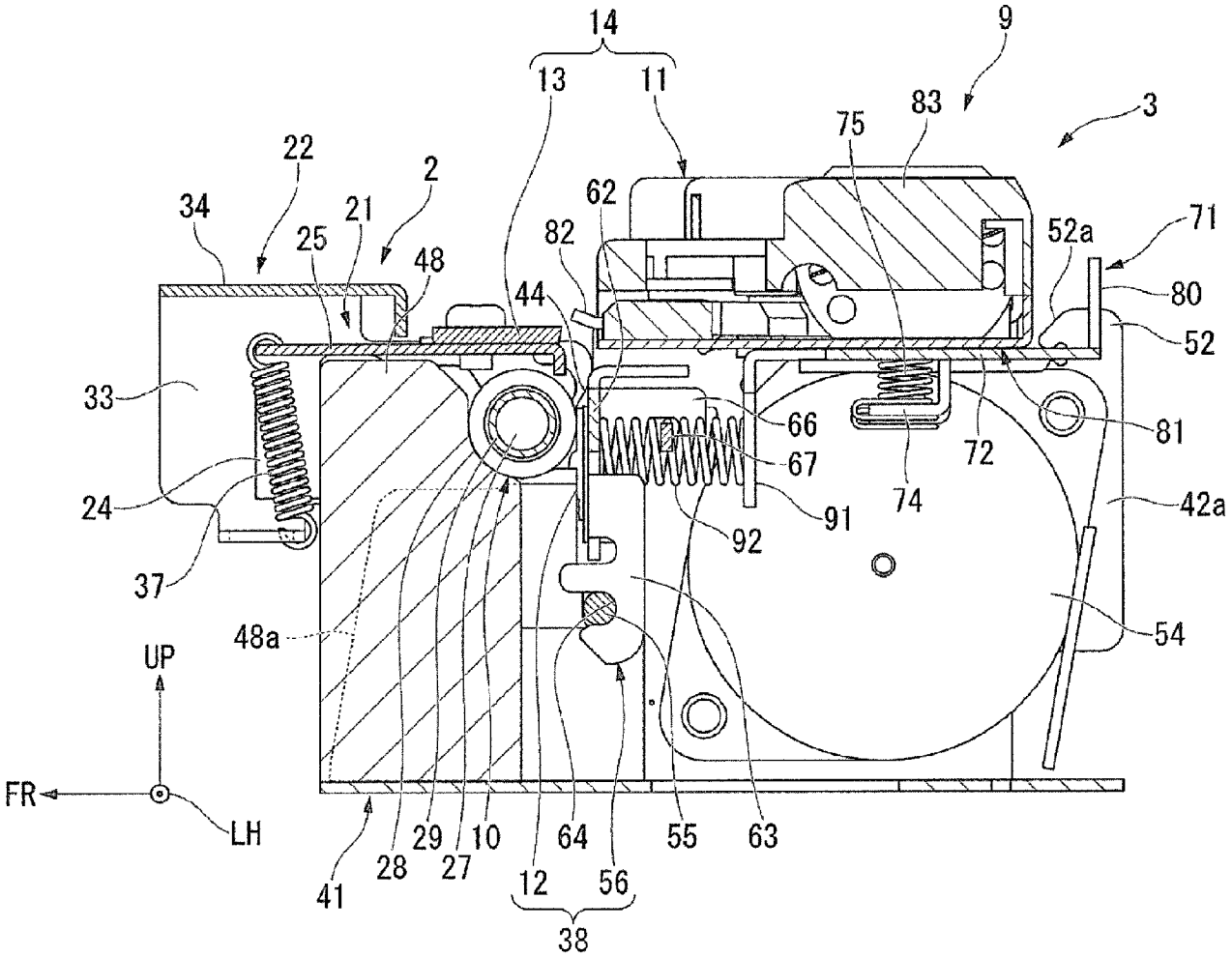
FIG. 5 is a sectional view taken along the line V-V in FIG. 4.

FIG. 3 is a side view of the printing unit 9, and FIG. 4 is an exploded perspective view of the printing unit 9. FIG. 5 is a sectional view taken along the line V-V in FIG. 4. As illustrated in FIG. 3 to FIG. 5, the platen unit 2 includes the platen roller 10 and the fixed blade 13, which are described above, a platen frame 21, and a subframe 22. The platen frame 21 supports the platen roller 10 and the fixed blade 13. The subframe 22 supports the platen frame 21.

First, the platen frame 21 is formed by bending a plate material made of a metal or the like, and has a U-like shape that is open downward in front view as viewed in a front-back direction. Specifically, the platen frame 21 includes a pair of shaft support portions 24 and a coupling portion 25. The shaft support portions 24 are respectively located on both end portions in a horizontal direction. The coupling portion 25 extends along the horizontal direction and bridges the shaft support portions 24. A bearing 29 for the platen roller 10, which is described later, is held in a rear end portion of each of the shaft support portions 24. A projecting piece 26 that projects outward in the horizontal direction is formed on a lower end portion of one of the shaft support portions 24, which is located on one end side (left side in the illustrations) in the horizontal direction.

The platen roller 10 is arranged so that an outer circumferential surface thereof comes into contact with the thermal head 12 under a state in which the recording sheet P is nipped between the platen unit 2 and the head unit 3 when the platen unit 2 and the head unit 3 are combined with each other while the printer cover 6 is in the closed position. Specifically, the platen roller 10 includes a platen shaft 27 and a roller main body 28. The platen shaft 27 extends along the horizontal direction. The roller main body 28 is made of a rubber or the like, and is mounted on the platen shaft 27.

The bearings 29 are respectively mounted on both end portions of the platen shaft 27. As described above, each of the bearings 29 is held by the platen frame 21. Through intermediation of the bearings 29, the platen roller 10 is rotatably supported by the platen frame 21. Further, a platen gear 31 is mounted on the other end portion (right end portion) of the platen shaft 27 (see FIG. 4). When the platen unit 2 and the head unit 3 are combined with each other, the platen gear 31 comes into meshing engagement with a platen gear train mechanism 53 (see FIG. 4) provided to the head unit 3, which is described later, to transmit a rotating force to the platen roller 10. In this manner, the recording sheet P can be fed while being nipped between the platen roller 10 and the thermal head 12.

The fixed blade 13 has a plate-like shape extending along the horizontal direction, and is fixed onto the coupling portion 25 of the platen frame 21 under a state in which a cutting edge of the fixed blade 13 is oriented to the rear.

The subframe 22 is slightly larger than the platen frame 21, and surrounds the platen frame 21 on an upper side and both sides in the horizontal direction. Specifically, the subframe 22 includes side wall portions 33 and a base portion 34. The side wall portions 33 are located on both sides in the horizontal direction. The base portion 34 couples the side wall portions 33. Each of the bearings 29 for the platen roller 10 is inserted freely into a rear end portion of corresponding one of the side wall portions 33.

Between the platen frame 21 and the subframe 22, a pair of pressure-applying mechanisms 37 configured to urge (apply a pressure to) the platen frame 21 about the platen shaft 27 in a direction away from the subframe 22 (downward) is interposed. Each of the pressure-applying mechanisms 37 is formed of, for example, a coil spring extending in a vertical direction. A lower end portion of each of the pressure-applying mechanisms 37 is individually coupled to the subframe 22, whereas an upper end portion thereof is coupled to the coupling portion 25 of the platen frame 21.

As illustrated in FIG. 3 to FIG. 5, the head unit 3 includes a head block 38 including the thermal head 12 described above, the movable blade 11, and a head frame 41. The head frame 41 supports the head block 38 and the movable blade 11 in a removable manner.

The head frame 41 is formed by bending a plate member made of a metal or the like, and has a U-like shape that is open upward in front view as viewed in the front-back direction. Engagement concave portions 44, with which the bearings 29 for the platen roller 10 are individually engaged, are formed in a pair of side wall portions 42*a* and 42*b* of the head frame 41, which are located on both sides in the horizontal direction. The engagement concave portions 44 are open upward, and have a width along the front-back direction, which gradually decreases in a downward direction. Further, a stopper portion 45, which comes into engagement with the corresponding one of the bearings 29 for the platen roller 10 from above when the printer cover 6 is located at the closed position, is formed on an inner circumferential edge of the engagement concave portion 44 so as to project to the rear.

In a front part of the head frame 41, a guide member 48 (see FIG. 4) is provided at a portion located between the side wall portions 42*a* and 42*b*. A guide passage 48*a* is formed in the guide member 48. The guide passage 48*a* guides the recording sheet P to the thermal head 12, and the above-mentioned roller main body 28 of the platen roller 10 is received in the guide passage 48*a* from above when the printer cover 6 is located at the closed position.

A first lock piece 51 that projects upward is formed at a rear part of each of the side wall portions 42*a* and 42*b* (portion located on the rear side with respect to each of the engagement concave portions 44). The first lock piece 51 has an L-like shape bent rearward in side view as viewed in the horizontal direction, and a frame fixing piece 85 of the movable blade 11, which is described later, can be inserted into the first lock piece 51. A second lock piece 52 that projects upward is formed on each of the side wall portions 42*a* and 42*b* at a portion located on the rear side with respect to the first lock piece 51 (rear end portion of each of the side wall portions 42*a* and 42*b*). The second lock piece 52 has an L-like shape bent forward in side view as viewed in the horizontal direction, and a frame fixing piece 77 of a support member 71, which is described later, can be inserted into the second lock piece 52. In the illustrated example, an upper end edge of the second lock piece 52 is formed as a tapered portion 52*a* extending downward in the forward direction.

As illustrated in FIG. 4, the platen gear train mechanism 53 is provided on the side wall portion 42*a* on the right side of the side wall portions 42*a* and 42*b*. The platen gear train mechanism 53 comes into meshing engagement with the platen gear 31 of the platen unit 2 when the platen unit 2 and the head unit 3 are combined with each other. The platen gear train mechanism 53 is connected to a platen motor 54 (see FIG. 5) mounted in the head frame 41. Through appropriate rotation of the platen motor 54, a rotating force of the platen motor 54 is transmitted to the platen gear 31 through intermediation of the platen gear train mechanism 53. As a result, the platen roller 10 is rotated.

Figure 6:
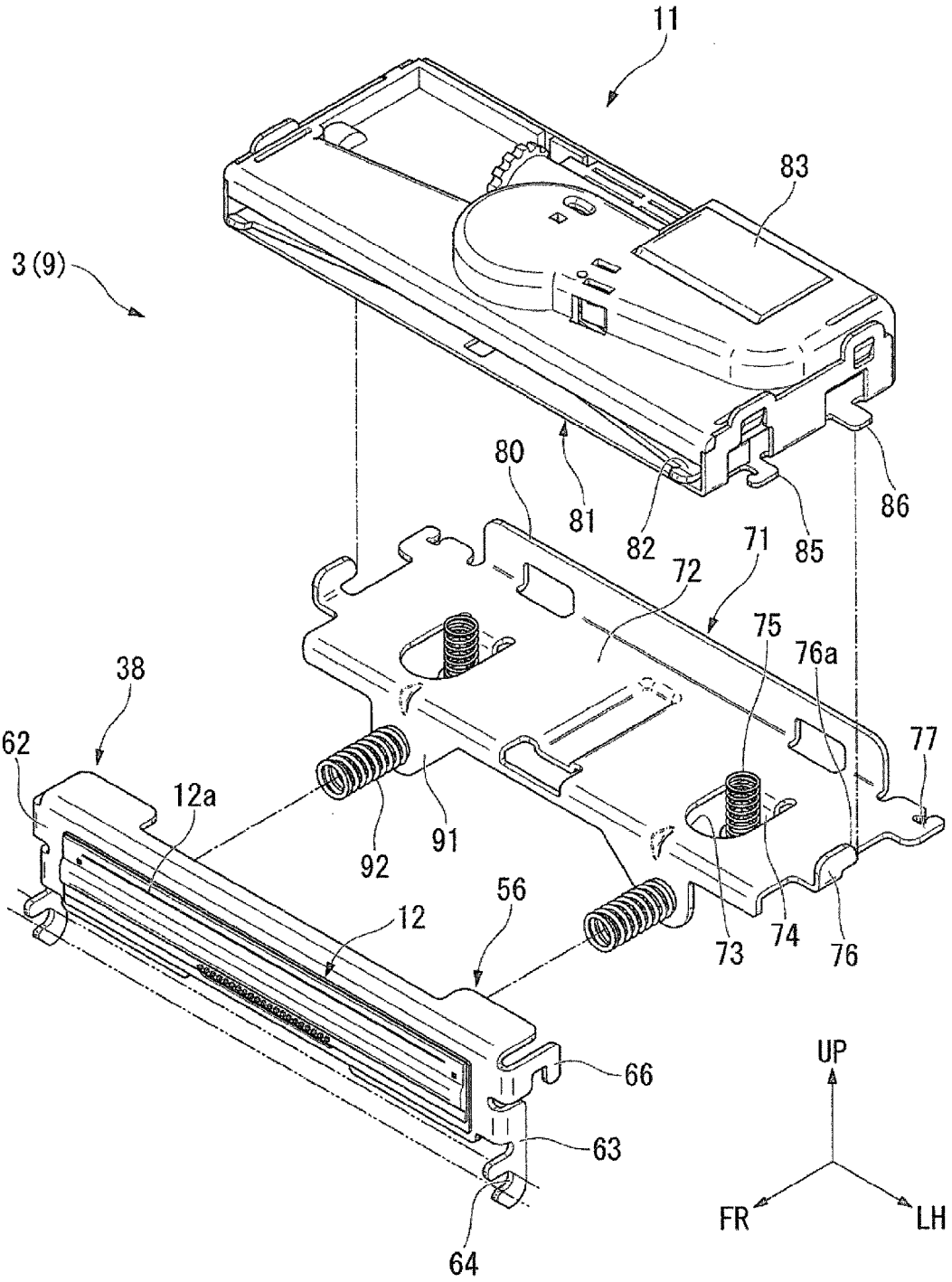
FIG. 6 is an exploded perspective view of a head block, a movable blade, and a support member.

FIG. 6 is an exploded perspective view of the head block 38, the movable blade 11, and the support member 71. As illustrated in FIG. 4 to FIG. 6, the head block 38 includes a head support 56 and the above-mentioned thermal head 12. The head support 56 is supported on a pivot shaft 55 provided in the head frame 41 so as to be pivotable about the pivot shaft 55. The thermal head 12 is fixed to the head support 56. The pivot shaft 55 is provided so as to extend along the horizontal direction, and both end portions of the pivot shaft 55 are individually supported by the side wall portions 42*a* and 42*b* of the head frame 41. As illustrated in FIG. 3, a release lever 61 configured to release the combination of the platen unit 2 and the head unit 3 is provided at a portion of the pivot shaft 55, which is located on the outer side with respect to the side wall portion 42*b* on the left side. The release lever 61 has a V-like shape in side view as viewed in the horizontal direction, and a corner portion of the release lever 61 is supported so as to be pivotable about the pivot shaft 55. A lever member (not shown) provided to the casing main body 5 is locked to a portion of the release lever 61, which is located on one end side with respect to the corner portion. A portion of the release lever 61, which is located on the other end side, comes into abutment against the above-mentioned projecting piece 26 of the platen frame 21 from below. In this manner, the release lever 61 pivots in conjunction with the operation of the lever member to push up the platen unit 2 through intermediation of the projecting piece 26, thereby separating the platen unit 2 from the head unit 3.

As illustrated in FIG. 4 to FIG. 6, the head support 56 is formed by bending a plate member made of a metal or the like and is arranged inside the head frame 41. Specifically, the head support 56 includes a head support wall 62 having the thermal head 12 fixed thereto, and a pair of stays 63 formed by individually bending rearward both end portions of the head support wall 62 in the horizontal direction.

The head support wall 62 has a thickness direction in the front-back direction and extends in the horizontal direction. An upper portion of the head support wall 62 is exposed to the inner side of the guide passage 48*a*.

A lower end portion of each of the stays 63 is located at a position lower than the head support wall 62. In the lower end portion of each of the stays 63, a receiving concave portion 64 configured to receive the above-mentioned pivot shaft 55 therein is formed. The receiving concave portion 64 has a C-like shape in side view as viewed in the horizontal direction and is open forward. With this, the head support 56 is pivotable about the pivot shaft 55 in the front-back direction (in a direction toward and away from the platen roller 10), and is mounted to the pivot shaft 55 in a removable manner. In the illustrated example, a lower end edge of each of the stays 63 (portion located lower than the receiving concave portion 64) is tapered to be inclined downward in a rearward direction.

A stopper wall 66 is formed on each of both end portions of the head support wall 62 in the horizontal direction at a portion located above each of the above-mentioned stays 63 so as to project rearward. The stopper wall 66 is locked to a regulating portion 67 of the head frame 41 to restrict a pivot range of the head block 38.

As illustrated in FIG. 4 and FIG. 6, the thermal head 12 has a plate-like shape extending along the horizontal direction (sheet width direction of the recording sheet P), and is fixed to a front surface of the head support wall 62. A plurality of heating elements 12*a* are arranged linearly on a surface of the thermal head 12. The heating elements 12*a* are exposed to the inside of the guide passage 48*a*, and are held in pressure-contact with an outer circumferential surface of the platen roller 10 (roller main body 28) when the printer cover 6 is located at the closed position.

As illustrated in FIG. 4 to FIG. 6, the support member 71 is supported at rear parts of the side wall portions 42*a* and 42*b* (portion located on the rear side with respect to the head block 38) so as to be slidable relative to the head frame 41 in the front-back direction. The support member 71 is formed by bending a plate member made of a metal or the like. The support member 71 supports the head block 38 from the rear side, and couples the movable blade 11 to the head frame 41. The support member 71 extends along the horizontal direction, and includes a base portion 72 that bridges upper end portions of the side wall portions 42*a* and 42*b*.

A pair of cutout portions 73 (see FIG. 6) passing through the base portion 72 in the vertical direction is formed in the base portion 72 so as to be arrayed in the horizontal direction. A protruding piece portion 74 is formed on a rear-end opening edge of each of the cutout portions 73. The protruding piece portion 74 projects forward so as to face an inside of each of the cutout portions 73 in plan view as viewed in the vertical direction. The protruding piece portion 74 has an L-like shape in side view as viewed in the horizontal direction. A proximal end of the protruding piece portion 74 is formed so as to extend downward from the rear-end opening edge of each of the cutout portions 73, whereas a distal end portion thereof is formed so as to extend forward. A movable-blade urging member (second urging member) 75 is provided to the distal end portion of the protruding piece portion 74. The movable-blade urging member 75 urges upward the movable blade 11. The movable-blade urging member 75 is formed of, for example, a coil spring. A lower end portion of the movable-blade urging member 75 is coupled to the distal end portion of the protruding piece portion 74, whereas an upper end portion thereof projects upward with respect to the base portion 72 through the cutout portion 73.

A pair of movable blade fixing pieces 76, which project outward in the horizontal direction, and the pair of frame fixing pieces 77 are respectively formed on both end portions of the base portion 72 in the horizontal direction. Each of the movable blade fixing pieces 76 has an L-like shape bent rearward in side view as viewed in the horizontal direction. A support member fixing piece 86 of the movable blade 11, which is described later, is locked to each of the movable blade fixing pieces 76. A rear end edge of each of the movable blade fixing pieces 76 has a curved shape that projects upward, which forms a guide portion 76*a* extending rearward in an upward direction. A first regulating protruding portion 78 that projects upward is formed on each of the side wall portions 42*a* and 42*b* at a portion located on the front side with respect to the above-mentioned movable blade fixing piece 76. The movable blade fixing piece 76 can come close to or into abutment against the first regulating protruding portion 78 from the rear side along with the sliding movement of the support member 71, thereby restricting forward movement of the support member 71.

The frame fixing piece 77 is formed on a portion of the base portion 72, which is located on the rear side with respect to the movable blade fixing piece 76. The frame fixing piece 77 has an L-like shape bent rearward in plan view as viewed from above. The frame fixing piece 77 is locked to the inside of the above-mentioned second lock piece 52 of the head frame 41, thereby regulating the movement of the support member 71 relative to the head frame 41 (movement in the vertical and horizontal directions and the rearward direction). A second regulating protruding portion 79 that projects upward is formed on each of the side wall portions 42*a* and 42*b* at a portion on the front side with respect to the fixing piece 77 for a frame. The frame fixing piece 77 can come close to or into abutment against the second regulating protruding portion 79 from the rear side along with the sliding movement of the support member 71, thereby restricting the forward movement of the support member 71.

An operation wall 80 is formed on a rear end portion of the base portion 72. The operation wall 80 allows the support member 71 to be operated to slide in the front-back direction. The operation wall 80 projects upward and is formed over the entire horizontal region of the base portion 72.

The movable blade 11 is mounted to the head frame 41 in a removable manner through intermediation of the support member 71. Specifically, the movable blade 11 includes a movable blade frame 81, a movable-blade main body 82, and a driving mechanism (motor for a movable blade) 83. The movable-blade main body 82 is supported on the movable blade frame 81 so as to be slidable. The driving mechanism 83 drives the movable-blade main body 82.

The pair of frame fixing pieces 85 are respectively formed on both end portions of the movable blade frame 81 in the horizontal direction. The pair of frame fixing pieces 85 are locked to the above-mentioned first lock piece 51 of the head frame 41. Each of the frame fixing pieces 85 is formed so as to project outward from the movable blade frame 81 in the horizontal direction. Each of the frame fixing pieces 85 has an L-like shape bent forward in plan view as viewed in the vertical direction. The frame fixing pieces 85 are inserted into the first lock pieces 51 of the head frame 41, thereby regulating the movement of the support member 71 relative to the head frame 41 (movement in the vertical and horizontal directions and the forward direction).

The support member fixing pieces 86 that project outward in the horizontal direction are formed on portions of the movable blade frame 81, which are each located on the rear side with respect to the frame fixing piece 85. Each of the support member fixing pieces 86 is formed so as to project outward from the movable blade frame 81 in the horizontal direction. Each of the support member fixing pieces 86 has a rectangular shape in plan view as viewed in the vertical direction. The support member fixing pieces 86 are received in the above-mentioned movable blade fixing pieces 76 of the support member 71, thereby regulating the movement of the movable blade 11 relative to the support member 71.

The movable-blade main body 82 has a V-like shape in plan view as viewed in the vertical direction so that a length from a bottom to a blade tip of the movable-blade main body 82 gradually decreases from both ends toward the center. The driving mechanism 83 includes a cutter motor rotatable in a forward direction and a reverse direction, which is mounted to the movable-blade frame 81, and a gear train mechanism connected between the cutter motor and the movable-blade main body 82. When a driving force of the cutter motor is transmitted to the movable-blade main body 82 through intermediation of the gear train mechanism, the movable-blade main body 82 is slid.

Figure 7:
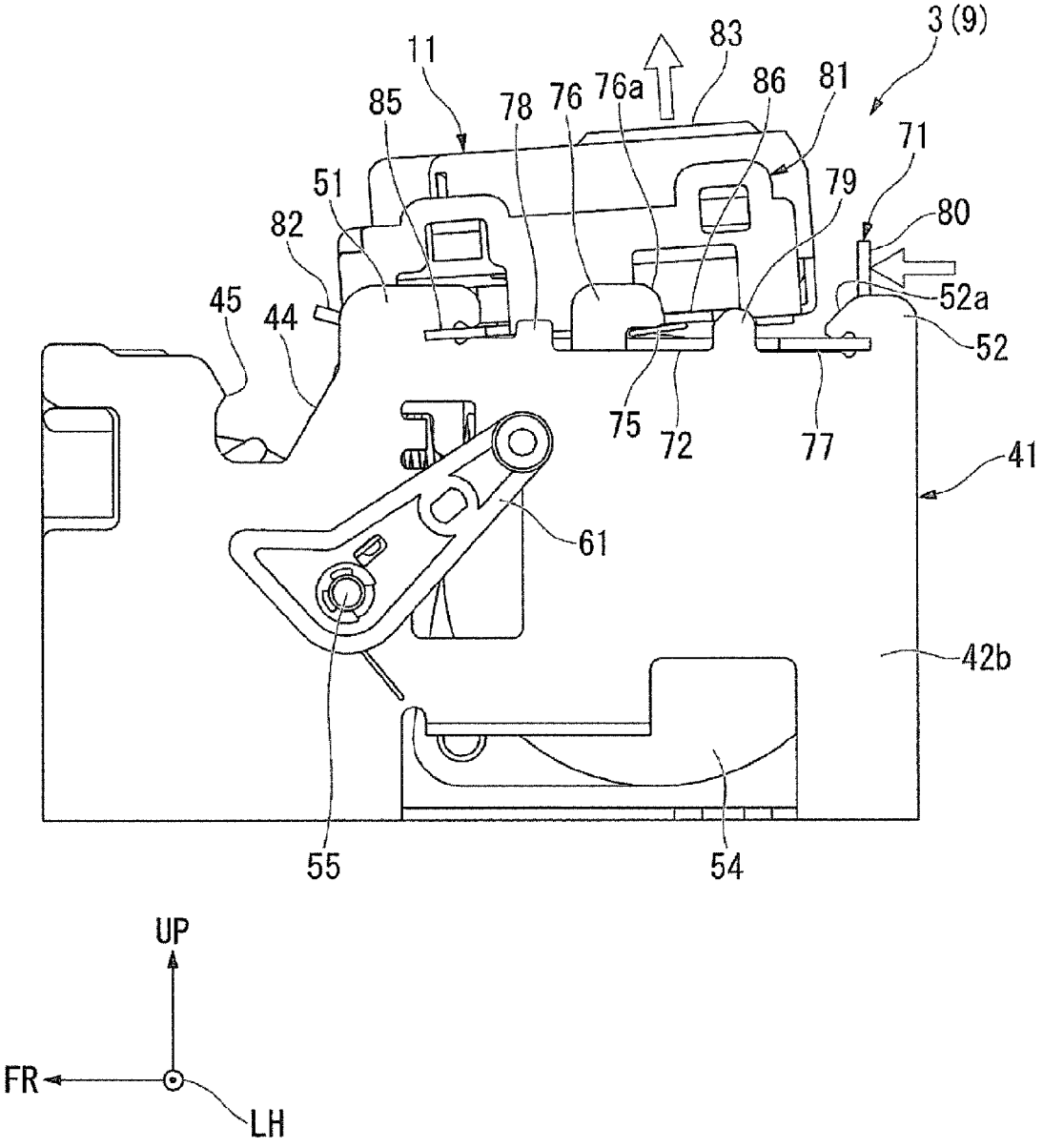
FIG. 7 is an explanatory diagram for illustrating an operation of mounting and removing the movable blade, which corresponds to a side view of a head unit.

In this case, the above-mentioned support member 71 is slidable relative to the movable blade 11 and the head frame 41 in the front-back direction in a range from a coupled position at which the movable blade 11 is coupled to the head frame 41 (see FIG. 3 and the like) to a decoupled position at which the movable blade 11 is detachable from the head frame 41 (see FIG. 7 and the like). Specifically, when the support member 71 is located at the coupled position, the movable blade fixing piece 76 of the support member 71 is locked by the support member fixing piece 86 of the movable blade 11 from the front side and the upper side, thereby regulating the upward movement of the support member fixing piece 86 relative to the support member 71. On the other hand, when the support member 71 is located at decoupled position illustrated in FIG. 7 and the like, the movable blade fixing piece 76 of the support member 71 retreats to a position at which the movable blade fixing piece 76 does not overlap the support member fixing piece 86 of the movable blade 11 in the vertical direction, thereby unlocking the movable blade fixing piece 76 and the support member fixing piece 86 from each other. With this, the upward movement of the movable blade 11 relative to the support member 71 is allowed.

A pair of receiving seats 91 extending downward is formed on a front end edge of the base portion 72 with a horizontal interval secured therebetween. The receiving seats 91 are arranged so as to be opposed to the head support wall 62 of the head block 38 in the front-back direction. Head urging members (first urging members) 92 are interposed between the receiving seats 91 and the head support wall 62. The head urging members 92 urge the support member 71 and the head block 38 in a direction away from each other in the front-back direction. Specifically, the head urging members 92 urge the head block 38 (thermal head 12) toward the platen roller 10, and urge the support member 71 toward the above-mentioned coupled position.

Further, the movable blade 11 is urged upward by the above-mentioned movable-blade urging members 75 provided to the support member 71. Specifically, a lower end portion of each of the movable-blade urging members 75 is coupled to the above-mentioned protruding piece portion 74 of the support member 71, whereas an upper end portion thereof is connected to a lower surface of the movable blade frame 81 so as to be slidable, thereby urging the movable blade 11 and the support member 71 in a direction away from each other in the front-back direction.

In the thermal printer 1 configured as described above, as illustrated in FIG. 2 and FIG. 3, under a state in which the printer cover 6 is located at the closed position and the units 2 and 3 are combined with each other, the movable blade 11 and the fixed blade 13 are arranged at a desired position, and the recording sheet P is nipped between the platen roller 10 and the thermal head 12. After passing between the movable blade 11 and the fixed blade 13, the recording sheet P is pulled out of the casing 4 through the discharge port 8. Further, the platen gear 31 of the platen unit 2 comes into meshing engagement with the platen gear train mechanism 53 provided to the head unit 3.

Thereafter, the platen motor 54 is driven so that the rotating force of the platen motor 54 is transmitted to the platen gear 31 of the platen unit 2. As a result, the platen roller 10 can be rotated so that the recording sheet P can be fed while the recording sheet P is nipped between the platen roller 10 and the thermal head 12. Simultaneously with the sheet feeding, various letters and figures can be clearly printed on the recording sheet P that is being fed, by appropriately allowing the heating elements 12*a* of the thermal head 12 to generate heat.

The printed recording sheet P passes between the fixed blade 13 and the movable blade 11. Then, after the passage of the recording sheet P by a predetermined length, the driving mechanism 83 is driven to slide the movable-blade main body 82 toward the fixed blade 13. In this manner, the recording sheet P can be cut between the fixed blade 13 and the movable blade 11. As a result, the recording sheet P thus cut can be used as a receipt or a ticket.

Next, as an action of the above-mentioned thermal printer 1, a method for replacing the head block 38 is described. First, the printer cover 6 is located at the opened position. Specifically, as illustrated in FIG. 3, when the lever member (not shown) provided to the casing main body 5 is operated, the release lever 61 pivots about the pivot shaft 55 in conjunction with the operation of the lever member. Then, the release lever 61 pushes up the platen unit 2 through intermediation of the projecting piece 26.

The platen roller 10 is detached from the engagement concave portions 44 while an outer circumferential surface of the roller main body 28 is pushing the head block 38 in a direction against the urging forces of the head urging member 92. Then, the bearings 29 of the platen roller 10 climb over the stopper portions 45, thereby disengaging the bearings 29 and the stopper portions 45 from each other. As a result, the combination of the units 2 and 3 is released as illustrated in FIG. 4. Thereafter, as illustrated in FIG. 1, the printer cover 6 is pulled up to bring the printer cover 6 into the opened position. When the combination of the units 2 and 3 is released, the head block 38 pivots forward by the urging forces of the head urging member 92. Thereafter, the stopper walls 66 come into contact with the regulating portions 67 of the head frame 41, thereby positioning the head block 38 with respect to the head frame 41.

Figure 8:
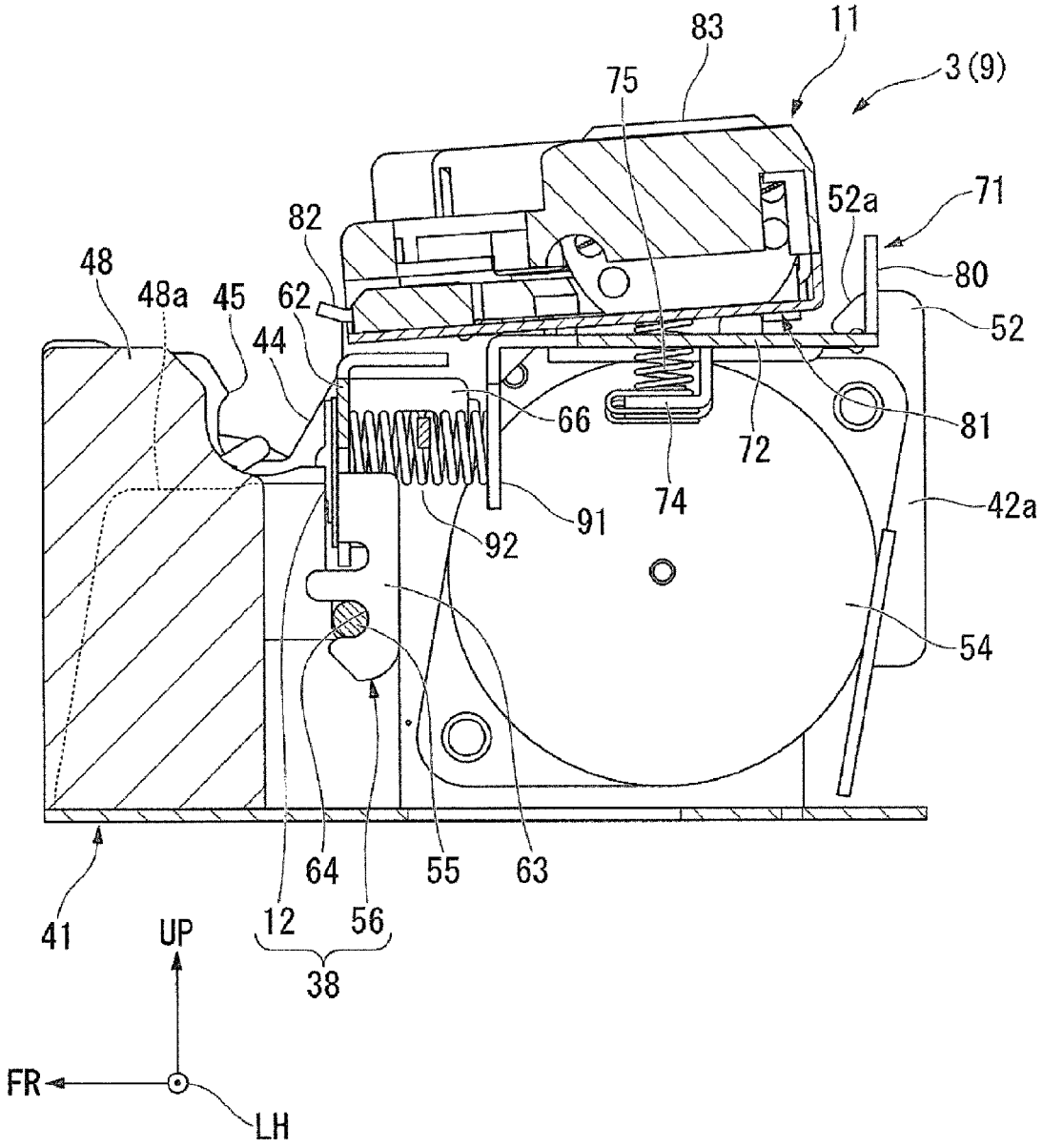
FIG. 8 is an explanatory diagram for illustrating the operation of mounting and removing the movable blade, which corresponds to a sectional view of the head unit.
Figure 9:
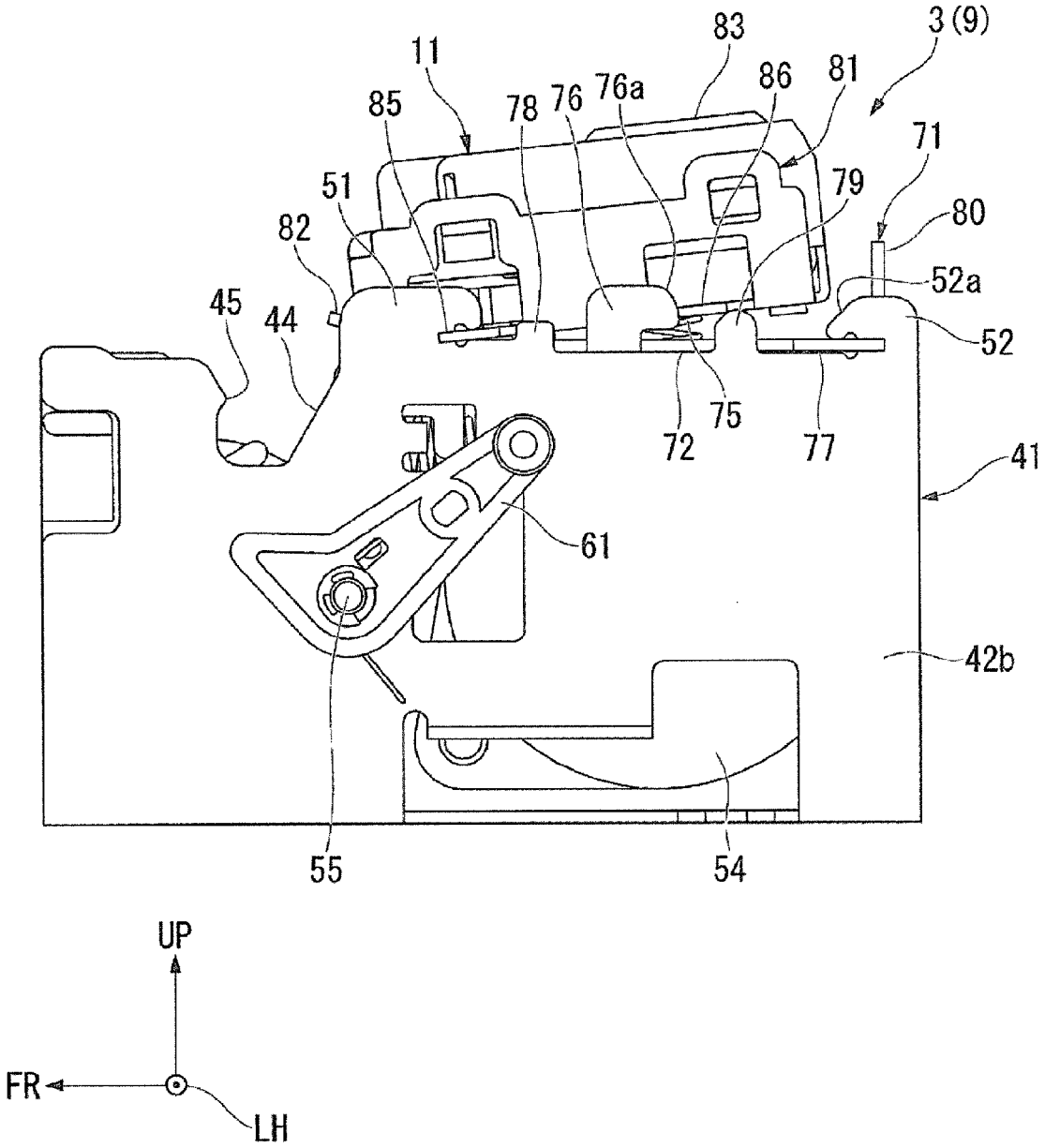
FIG. 9 is an explanatory diagram for illustrating the operation of mounting and removing the movable blade, which corresponds to a side view of the head unit.
Figure 10:
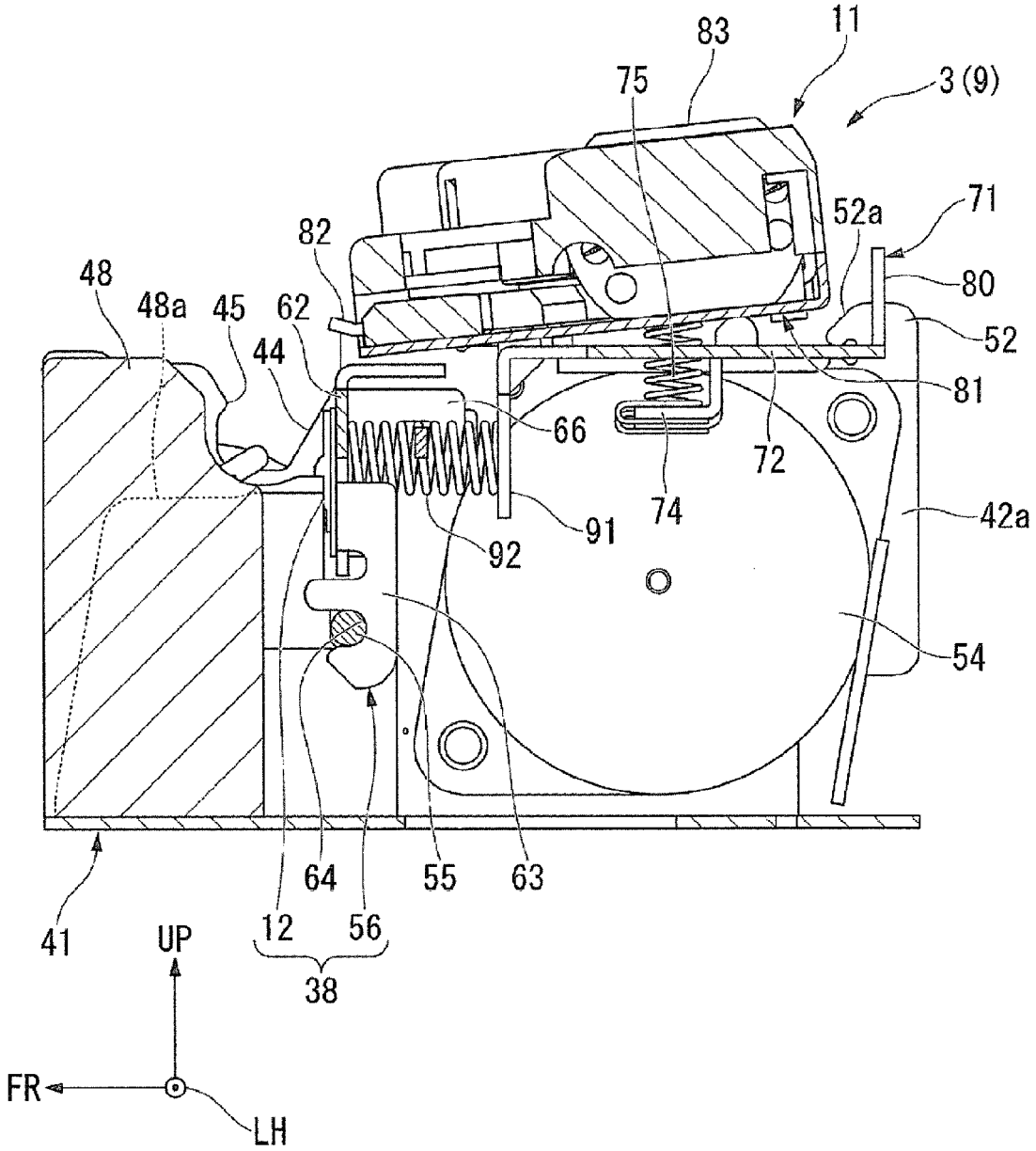
FIG. 10 is an explanatory diagram for illustrating the operation of mounting and removing the movable blade, which corresponds to a sectional view of the head unit.

FIG. 7 to FIG. 10 are explanatory diagrams for illustrating an operation of mounting and removing the movable blade 11. FIG. 7 and FIG. 9 are side views of the head unit, whereas FIG. 8 and FIG. 10 are sectional views of the head unit. In order to remove the head block 38 from the head unit 3, first, the movable blade 11 is removed from the head unit 3. Specifically, as illustrated in FIG. 7 and FIG. 8, the support member 71 is pushed forward (in the direction against the urging forces of the head urging members 92) through intermediation of the operation wall 80, thereby moving the support member 71 to the decoupled position. Then, the support member 71 is slid forward relative to the head frame 41 while upper end portions of the movable-blade urging members 75 are slid on the lower surface of the movable blade frame 81. When the support member 71 is moved forward, the movable blade fixing pieces 76 of the support member 71 each retreat from above the support member fixing piece 86 of the movable blade 11, thereby unlocking the movable blade fixing pieces 76 and the support member fixing pieces 86 from each other. With this, the support member 71 is located at the decoupled position so that the upward movement of the movable blade 11 relative to the head frame 41 is allowed.

When the support member 71 is located at the decoupled position, the movable blade 11 is pushed up due to the restoring forces of the movable-blade urging members 75. With this, the movable blade 11 is moved upward relative to the support member 71 so that the support member fixing pieces 86 are detached from the movable blade fixing pieces 76 of the support member 71, thereby decoupling the movable blade 11 and the support member 71 from each other. While the movable blade 11 is being moved upward relative to the support member 71, the frame fixing pieces 85 of the movable blade 11 are maintained to be inserted into the first lock pieces 51 of the head frame 41. Therefore, the movable blade 11 is moved upward while pivoting about the contact portions each between the frame fixing piece 85 and the first lock piece 51 as fulcrums.

Thereafter, as illustrated in FIG. 9 and FIG. 10, the movable blade 11 is pulled out to detach the frame fixing pieces 85 from the first lock pieces 51. With this, the movable blade 11 is removed from the head frame 41 and the support member 71.

Figure 11:
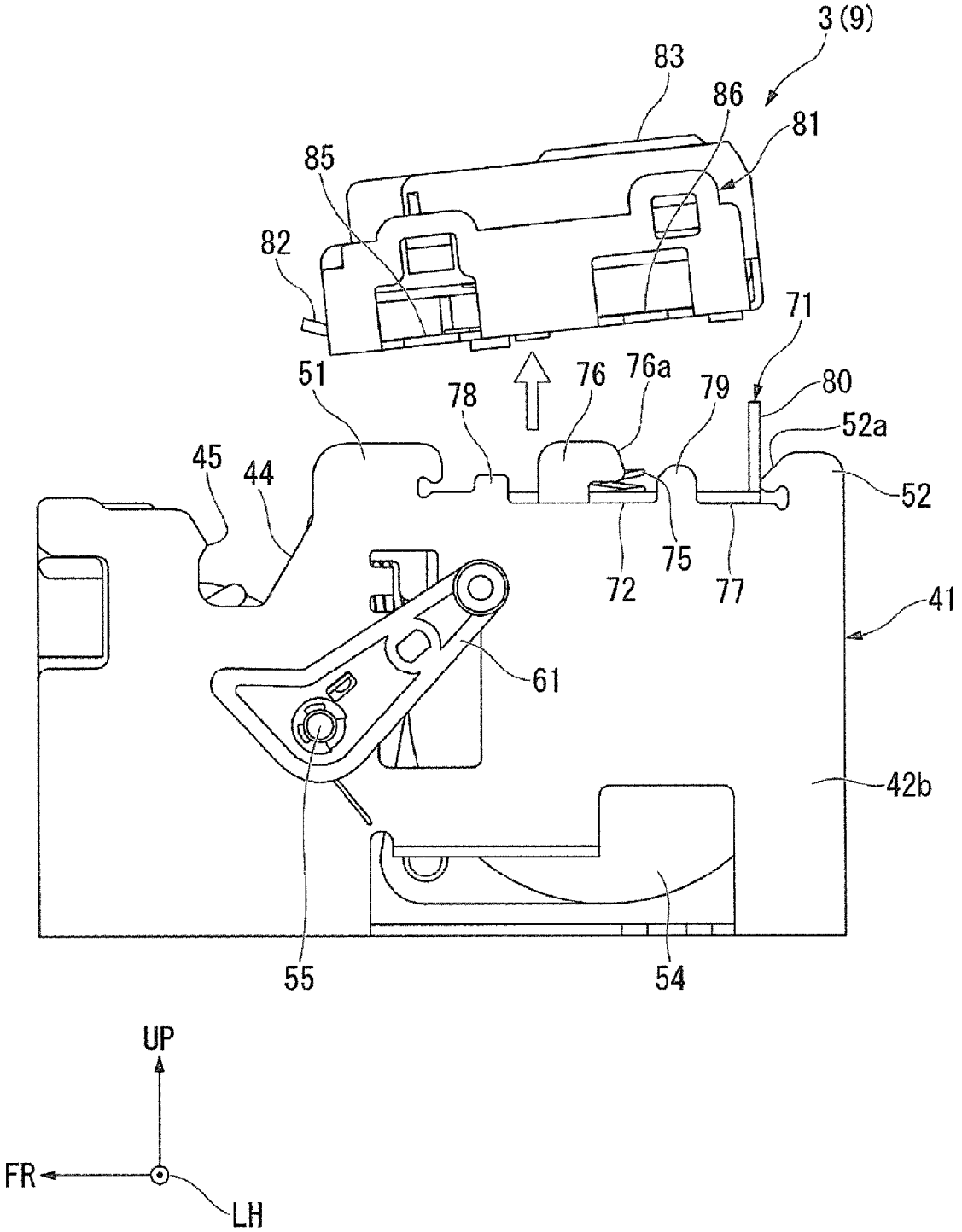
FIG. 11 is an explanatory diagram for illustrating an operation of mounting and removing the support member, which corresponds to a side view of the head unit.

FIG. 11 is an explanatory diagram for illustrating an operation of mounting and removing the support member 71, which corresponds to a side view of the head unit 3. Next, as illustrated in FIG. 11, the support member 71 is removed from the head frame 41. Specifically, the support member 71 is slid further forward from the above-mentioned decoupled position. Then, the frame fixing pieces 77 of the support member 71 each retreat from the inside of the second lock piece 52 of the head frame 41, thereby decoupling the support member 71 and the head frame 41 from each other. Thereafter, the support member 71 is pushed up to remove the support member 71 from the head frame 41 (see FIG. 12). In this embodiment, the head urging members 92 are removed from the head frame 41 together with the support member 71.

Figure 12:
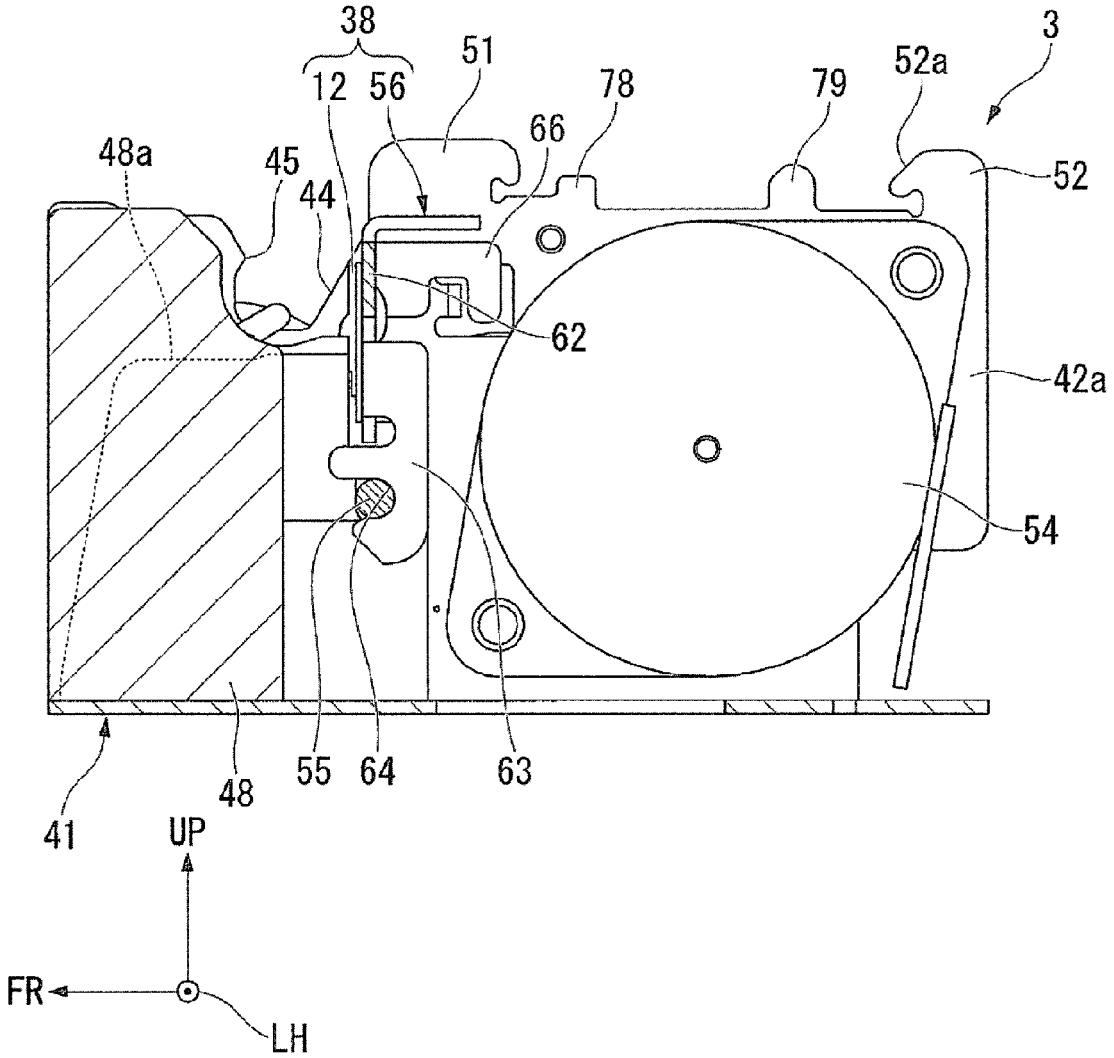
FIG. 12 is an explanatory diagram for illustrating an operation of mounting and removing the head block, which corresponds to a sectional view of the head unit.
Figure 13:
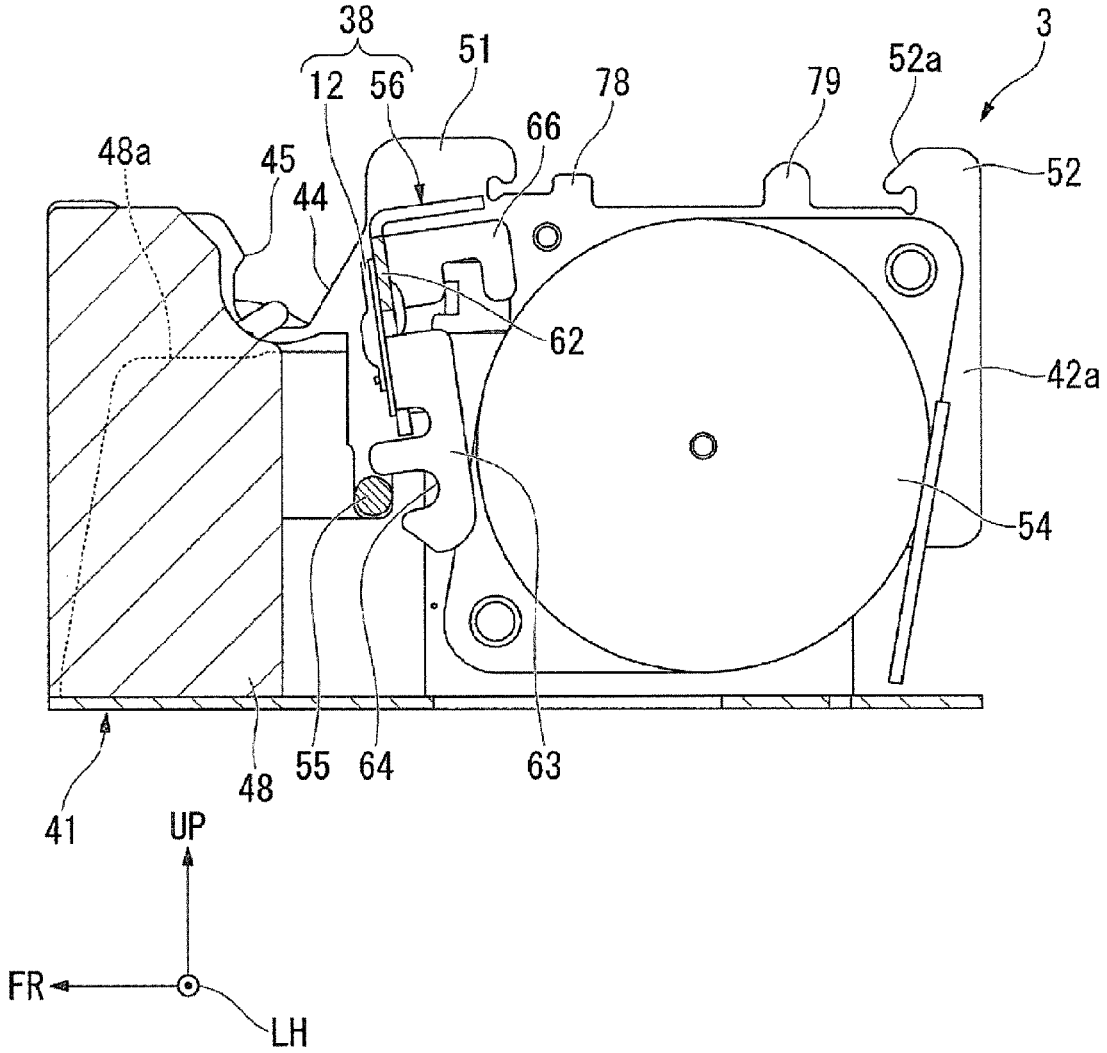
FIG. 13 is an explanatory diagram for illustrating the operation of mounting and removing the head block, which corresponds to a sectional view of the head unit.
Figure 14:
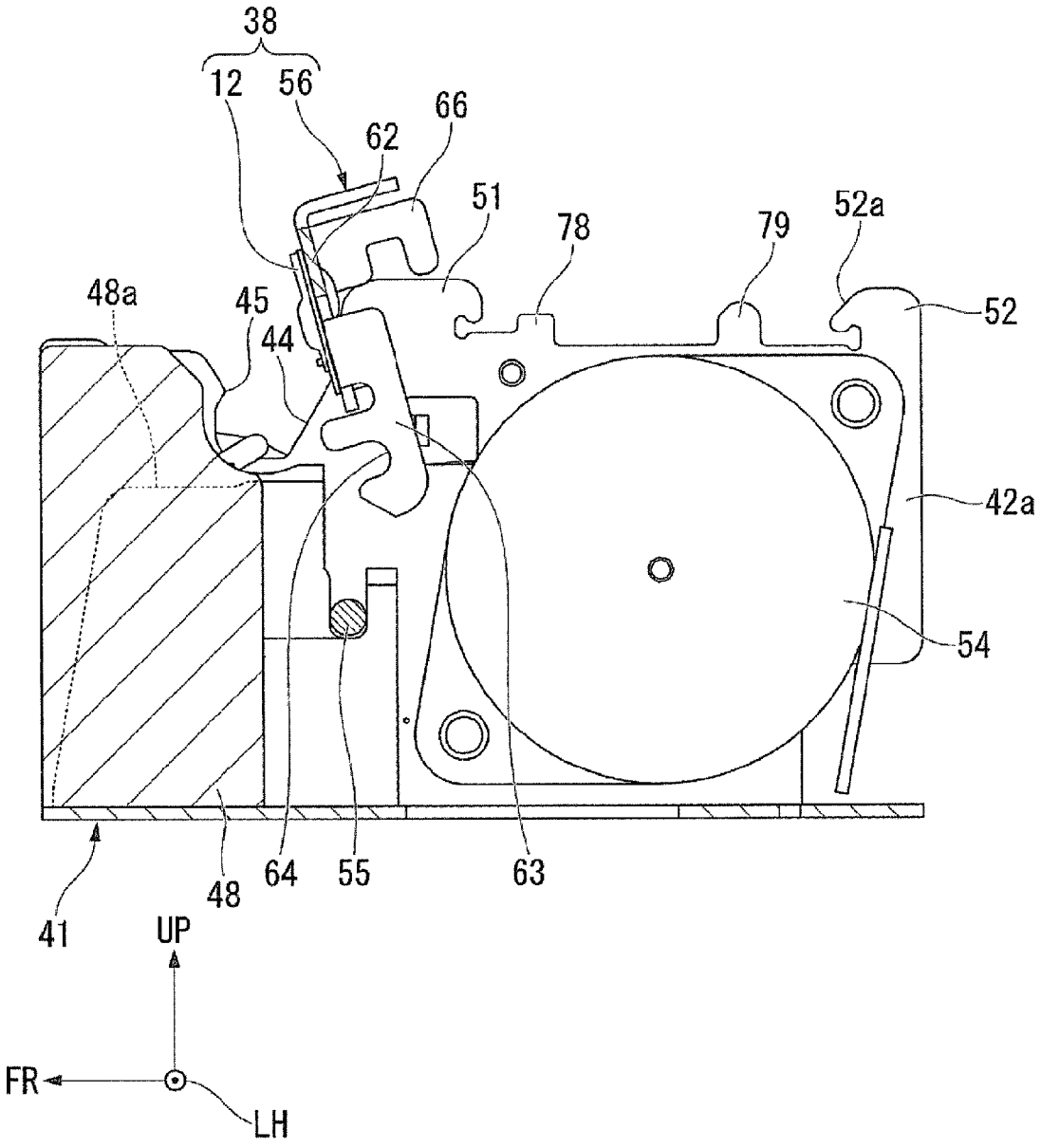
FIG. 14 is an explanatory diagram for illustrating the operation of mounting and removing the head block, which corresponds to a sectional view of the head unit.

FIG. 12 to FIG. 14 are explanatory diagrams for illustrating an operation of mounting and removing the head block 38, which correspond to sectional views of the head unit 3. Next, as illustrated in FIG. 12 and FIG. 13, the head block 38 is removed from the head frame 41. Specifically, the head block 38 is moved rearward with respect to the head frame 41 to detach the pivot shaft 55 from the receiving concave portions 64 of the head support 56.

Next, as illustrated in FIG. 14, the head block 38 is pulled upward. Then, the head block 38 is pulled out of the head frame 41 through a gap between the side wall portions 42*a* and 42*b* of the head frame 41. Through the operation described above, the head block 38 is removed from the head unit 3.

For mounting a new head block 38 onto the head unit 3, the reverse of the above-mentioned removing operation is performed. Specifically, after the head block 38 is inserted into the head frame 41 through the gap between the side wall portions 42*a* and 42*b* of the head frame 41, the pivot shaft 55 is inserted into the receiving concave portions 64 of the head support 56.

Next, the support member 71 is mounted to the head frame 41. Specifically, under a state in which front end portions of the head urging members 92 are brought into contact with the head support wall 62 of the head support 56 from the rear side, the frame fixing pieces 77 of the support member 71 are inserted into the second lock pieces 52 of the head frame 41. With this, the support member 71 is mounted to the side wall portions 42*a* and 42*b* of the head frame 41.

Thereafter, the movable blade 11 is mounted to the head frame 41. Specifically, the frame fixing pieces 85 of the movable blade 11 are inserted into the first lock pieces 51 of the head frame 41. Thereafter, the movable blade 11 is pushed down. Then, the support member fixing pieces 86 of the movable blade 11 come into contact with the guide portions 76*a* of the movable blade fixing pieces 76 of the support member 71. The movable blade 11 is further pushed down under this state. Then, due to the pushing force of the movable blade 11, the support member 71 is slid forward (toward the decoupled position) while the support member fixing pieces 86 are each slid on the guide portion 76*a* of the movable blade fixing piece 76 so that the movable blade 11 is moved downward.

Then, when the support member fixing pieces 86 climb over the rear end edges of the movable blade fixing pieces 76, the support member 71 is slid rearward (toward the coupled position) due to the restoring forces of the head urging members 92. With this, the support member fixing pieces 86 are locked to the movable blade fixing pieces 76 so that the movable blade 11 is mounted to the head frame 41 through intermediation of the support member 71. Through the operation described above, the head block 38 can be replaced.

As described above, in this embodiment, the support member 71 is movable between the coupled position and the decoupled position, and the head urging members 92 configured to urge the support member 71 toward the coupled position are provided. According to this configuration, the support member 71 is urged toward the coupled position. Therefore, the state in which the movable blade 11 and the head frame 41 are coupled to each other can be maintained by the support member 71 interposed therebetween. On the other hand, for removal of the movable blade 11, the movable blade 11 and the head frame 41, which are coupled through intermediation of the support member 71, can be easily decoupled from each other only by moving the support member 71 toward the decoupled position. With this, for example, an operator can easily move on to work of replacing the head block 38, which is carried out thereafter, thereby being capable of reducing a time period required for maintenance. Further, unlike the related-art case where the movable blade 11 and the head frame 41 are coupled to each other with fastening members such as screws, tools are not required to be used for work of mounting and removing the movable blade 11. Therefore, the maintainability can be enhanced.

In particular, in this embodiment, the support member 71 is urged toward the coupled position by the head urging members 92 configured to urge the thermal head 12 toward the platen roller 10. Therefore, both the operations of pressurizing the head and urging the support member 71 can be performed by the head urging members 92. With this, as compared to a case where the operations of pressurizing the head and urging the support member 71 are performed by different urging members, the increase in number of components can be suppressed to achieve cost reduction.

Further, as described above, the work of mounting and removing the movable blade 11 can be easily carried out. Therefore, the work of replacing the head block 38 can be easily carried out as a whole.

Still further, the support member 71 is slidable along the urging direction of the head urging members 92. Therefore, for example, as compared to a case where the support member 71 is moved through pivot or the like, the amount of displacement between the coupled position and the decoupled position can be reduced. With this, the printing unit 9 can be reduced in size and the layout efficiency can be enhanced.

Still further, the movable blade 11 is locked to the movable blade fixing pieces 76 of the support member 71 at the support member fixing pieces 86, and is inserted into the first lock pieces 51 of the head frame 41 at the fixing pieces 85 for a frame. Therefore, the movable blade 11 is coupled to both the head frame 41 and the support member 71. Accordingly, the movable blade 11 can be mounted to the head frame 41 at a desired position.

Still further, the movable-blade urging members 75 configured to urge the movable blade 11 in the direction of detaching the movable blade 11 from the head frame 41 (upward) are provided. Therefore, when the support member 71 is located at the decoupled position, the movable blade 11 is automatically detached from the support member 71. Accordingly, the movable blade 11 can be detached from the support member 71 only through a single operation of pushing the support member 71 to the decoupled position without time and effort in detaching the movable blade 11 from the support member 71 under a state in which the support member 71 is pushed to the decoupled position or the like. With this, the maintainability can be further enhanced.

In addition, the thermal printer 1 of this embodiment includes the above-mentioned printing unit 9. Therefore, the thermal printer 1 excellent in maintainability can be provided.

Note that, the technical scope of the present invention is not limited to the above-mentioned embodiment, but various modifications can be made without departing from the gist of the present invention.

For example, in the embodiment described above, the fixed blade 13 is provided to the platen frame 21, whereas the movable blade 11 is provided to the head frame 41. However, the configuration is not limited thereto. Specifically, the movable blade 11 may be provided to the platen frame 21, whereas the fixed blade 13 serving as the cutter mechanism of the present invention may be provided to the head frame 41.

Further, in the above-mentioned embodiment, the configuration that the support member 71 is slidable is described. However, the present invention is not limited thereto. The configuration that the support member 71 is pivotable and the like may be appropriately changed in design as long as the support member 71 is movable relative to the head frame 41. Further, in the above-mentioned embodiment, the configuration that the movable-blade urging members 75 are provided to the support member 71 is described. However, the present invention is not limited thereto, and the movable-blade urging members 75 may be provided to the head frame 41. Further, in the above-mentioned embodiment, the configuration that the movable blade 11 is locked to both the support member 71 and the head frame 41 is described. However, the movable blade 11 only needs to be locked to at least the support member 71.

Further, in the above-mentioned embodiment, the configuration that the receiving concave portions 64 of the head support 56 are open forward is described. However, the present invention is not limited thereto. For example, the pivot shaft 55 may be inserted into a through hole formed in the head support 56.

Figure 15:
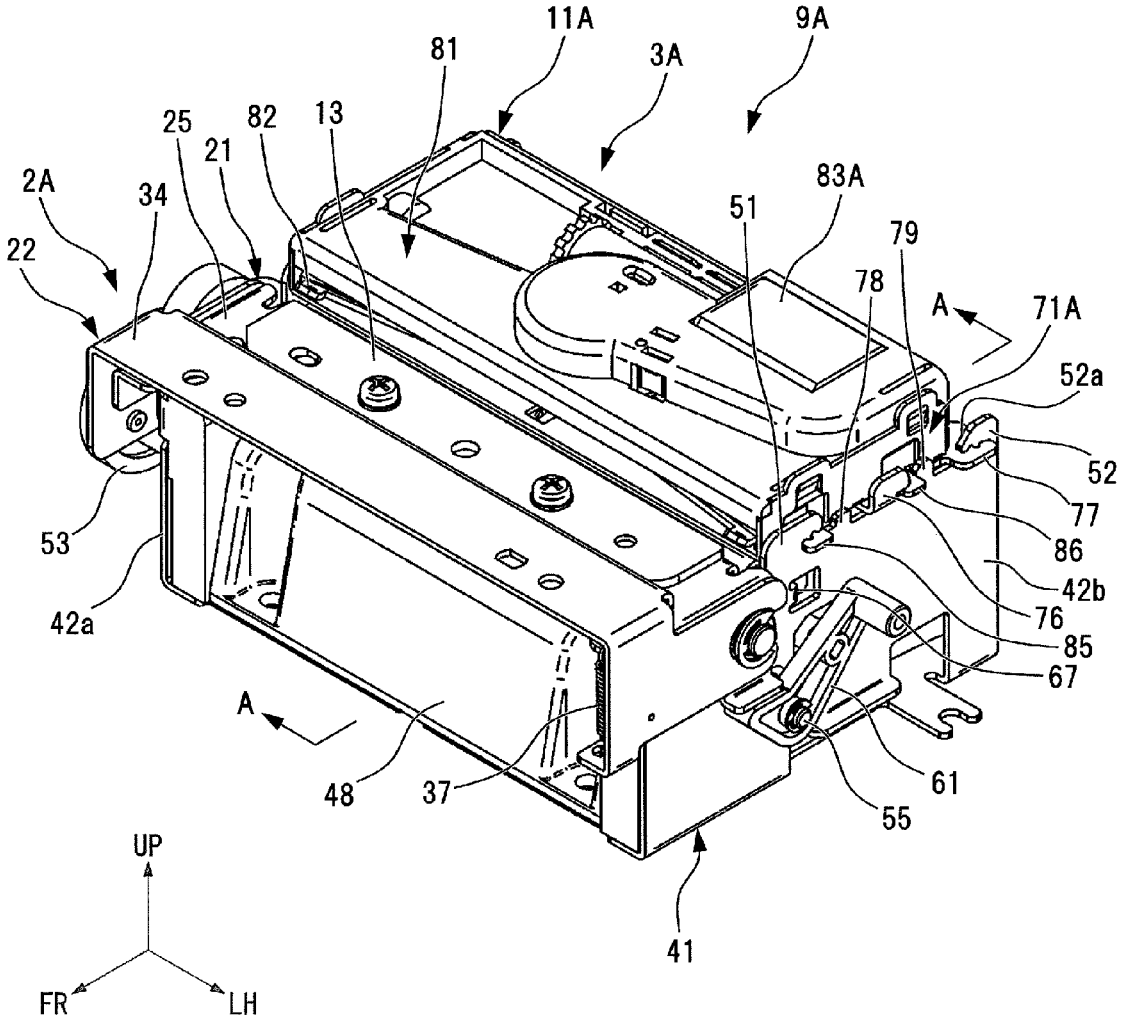
FIG. 15 is a perspective view for illustrating a printing unit according to another embodiment of the present invention.
Figure 16:
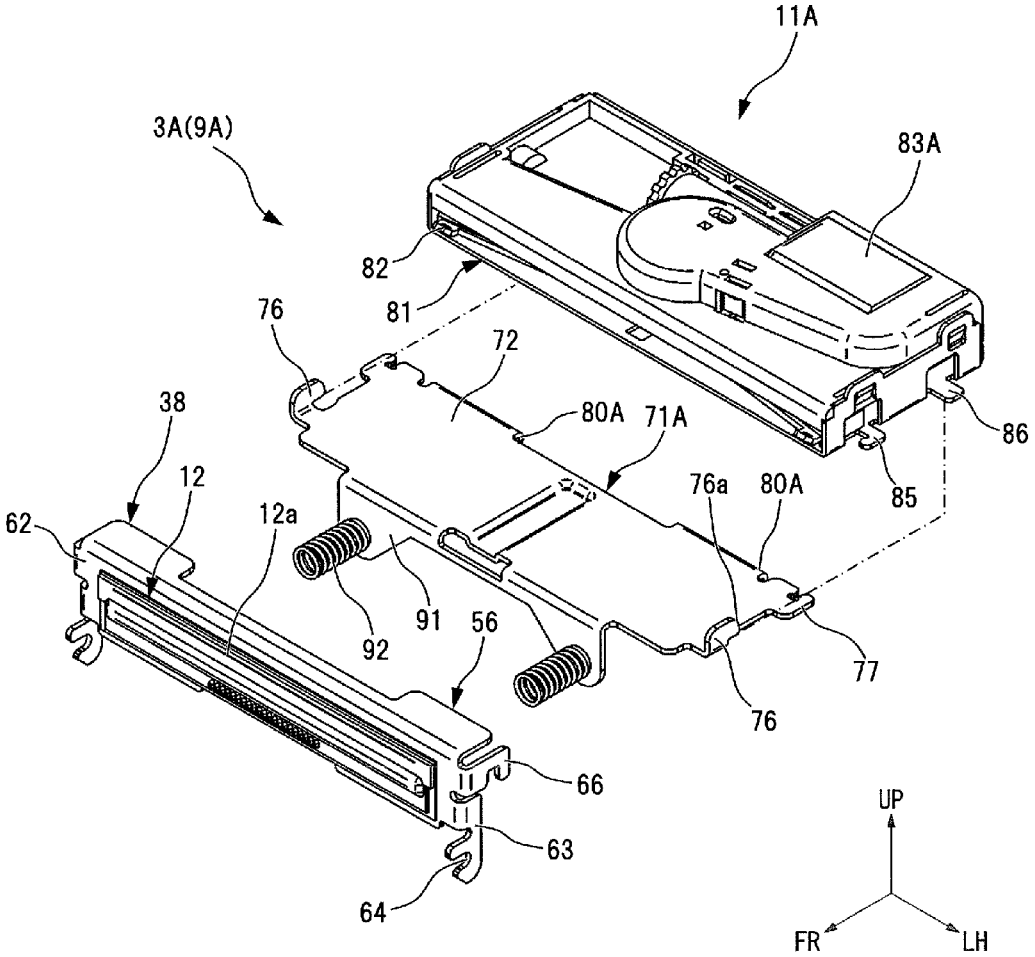
FIG. 16 is an exploded perspective view of the head block, the movable blade, and the support member, for illustrating the printing unit according to another embodiment.
Figure 17:
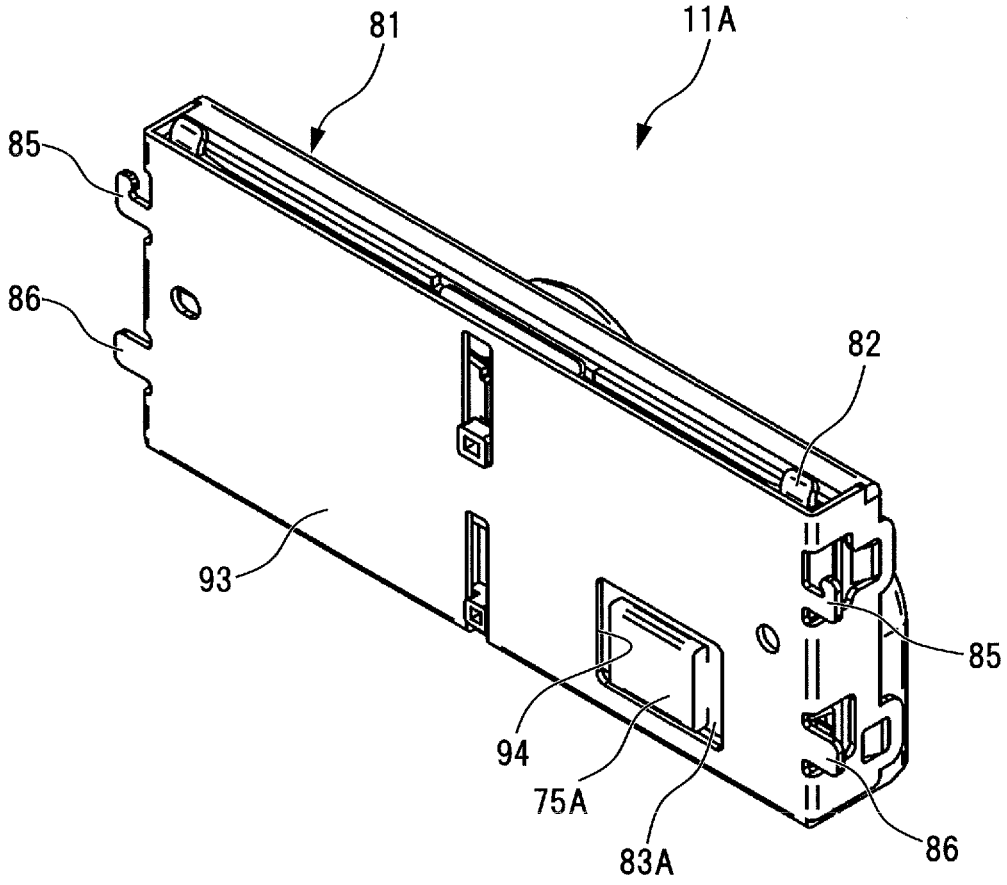
FIG. 17 is a perspective view of the movable blade in FIG. 16 as viewed from a bottom surface thereof.
Figure 18:
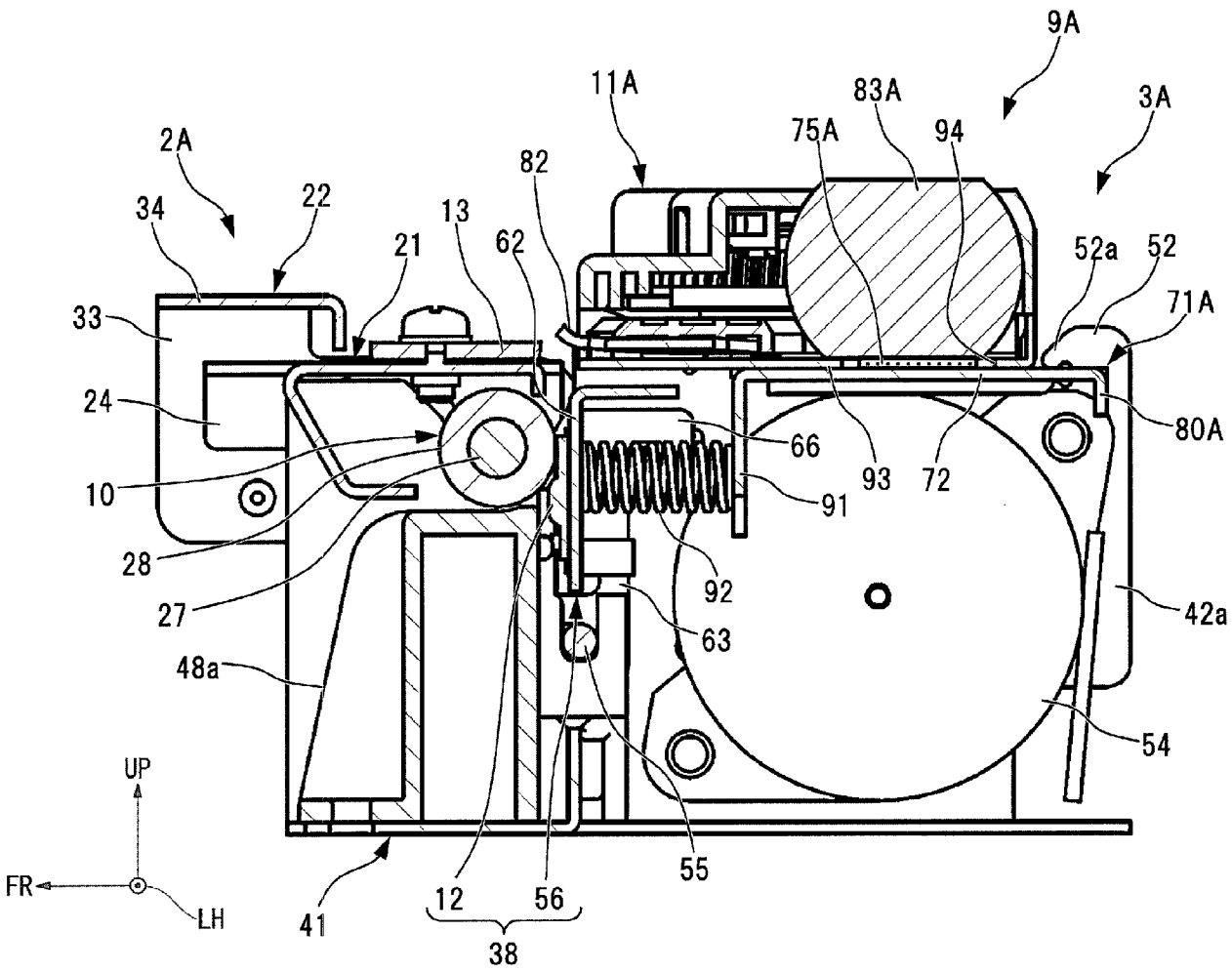
FIG. 18 is a sectional view taken along the line A-A in FIG. 15, for illustrating the printing unit according to the another embodiment.

Next, another embodiment of the present invention is described referring to the drawings. In this embodiment, the same components as those of the above-mentioned embodiment are denoted by the same reference symbols, and description thereof is omitted herein. FIG. 15 is a perspective view for illustrating a printing unit according to another embodiment. Further, FIG. 16 is an exploded perspective view of the head block of the printing unit, the movable blade, and the support member according to another embodiment. FIG. 17 is a perspective view of the movable blade in FIG. 16 as viewed from a bottom surface thereof. Still further, FIG. 18 is a sectional view taken along the line A-A in FIG. 15, for illustrating the printing unit according to the another embodiment.

A printing unit 9A of this embodiment includes a platen unit 2A and a head unit 3A, which are combined with each other separably. The platen unit 2 of the above-mentioned embodiment includes the pressure-applying mechanisms 37 in both end portions so as to be interposed between the platen frame 21 and the subframe 22, which are configured to urge (apply the pressure to) the platen frame 21 about the platen shaft 27 in the direction away from the subframe 22 (downward). On the other hand, the platen unit 2A of this embodiment includes the pressure-applying mechanism 37 only on one side portion. Even when the pressure-applying mechanism 37 is provided only on one side, the same actions and effects as those obtained by the above-mentioned embodiment can be obtained as long as the platen frame 21 and the subframe 22 have sufficient strength.

The head unit 3A includes the head block 38 including the thermal head 12, a movable blade 11A, the head frame 41, and a support member 71A. The head frame 41 supports the head block 38 and the movable blade 11A in a removable manner. The support member 71A supports the head block 38 from the rear side, and couples the movable blade 11A to the head frame 41.

In the head unit 3A of this embodiment, operation walls 80A configured to slide the support member 71A in the front-back direction are formed so that rear end portions of the base portion 72 project downward. With this configuration, the pressing forces applied through intermediation of the operation walls 80A during an operation of mounting and removing the movable blade 11A are effectively applied in the direction against the urging forces of the head urging members 92. Therefore, the support member 71A can be easily pushed to the decoupled position.

As illustrated in FIG. 17, the movable blade 11A has a cutout portion 94 formed in a bottom surface 93 opposed to the support member 71A at a position located below a motor 83A for a movable blade. A conductive sponge member 75A is mounted on a part of the motor 83A for a movable blade, which is exposed from the bottom surface 93 through the cutout portion 94. Similarly to the above-mentioned movable-blade urging members (second urging members) 75, the conductive sponge member 75A urges upward the movable blade 11A when the movable blade 11A is mounted to the support member 71A. With this, when the support member 71A is located at the decoupled position, the movable blade 11A can be automatically detached from the support member 71A.

Further, in the head unit 3A of this embodiment, when the movable blade 11A is mounted to the support member 71A, the conductive sponge member 75A is provided under a state in which the conductive sponge member 75A comes into contact with the support member 71A formed of a metal material and the motor 83A for a movable blade. With this, electrical conduction of the motor 83A for a movable blade is ensured. Therefore, the reliability of the motor for a movable blade can be enhanced without additionally providing a new member.

Figure 19:
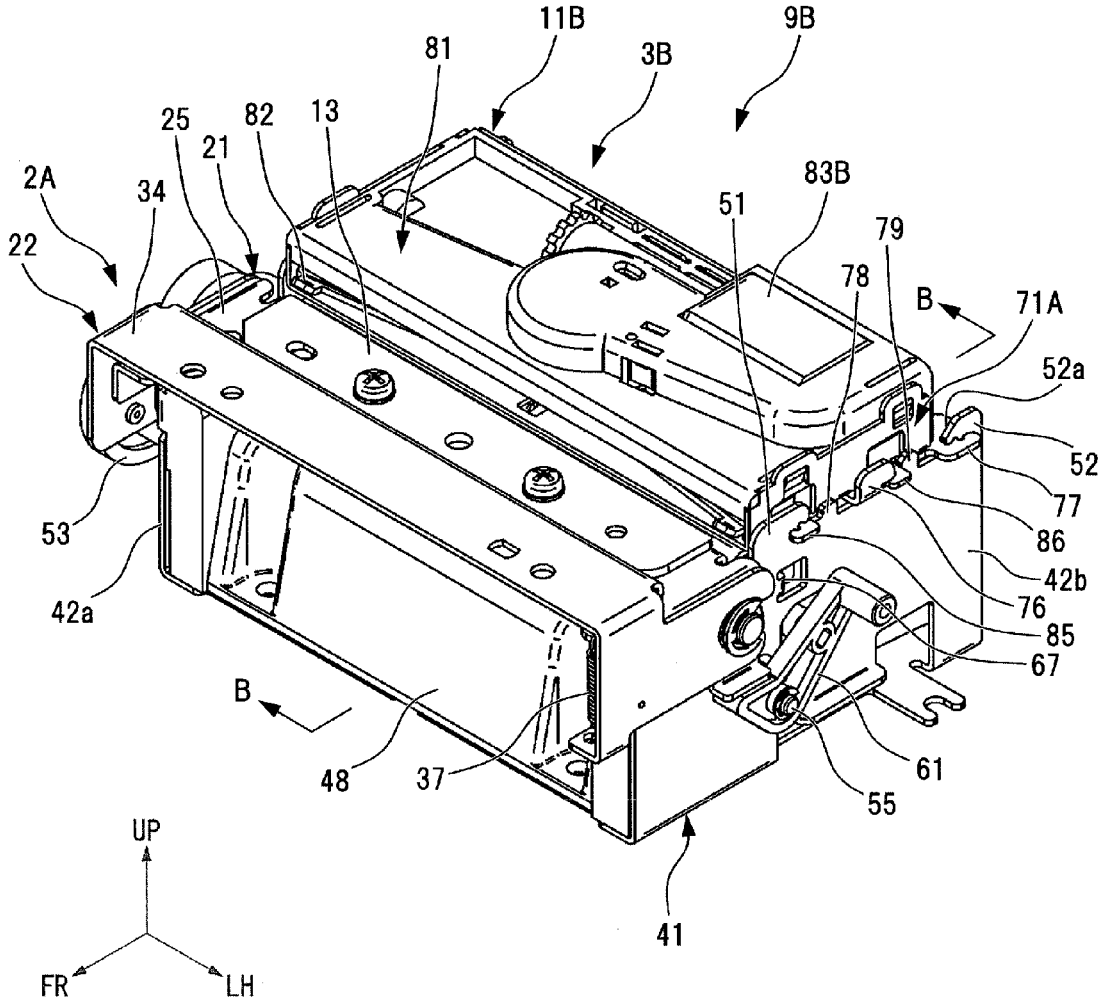
FIG. 19 is a perspective view for illustrating a modified example of the printing unit according to another embodiment.
Figure 20:
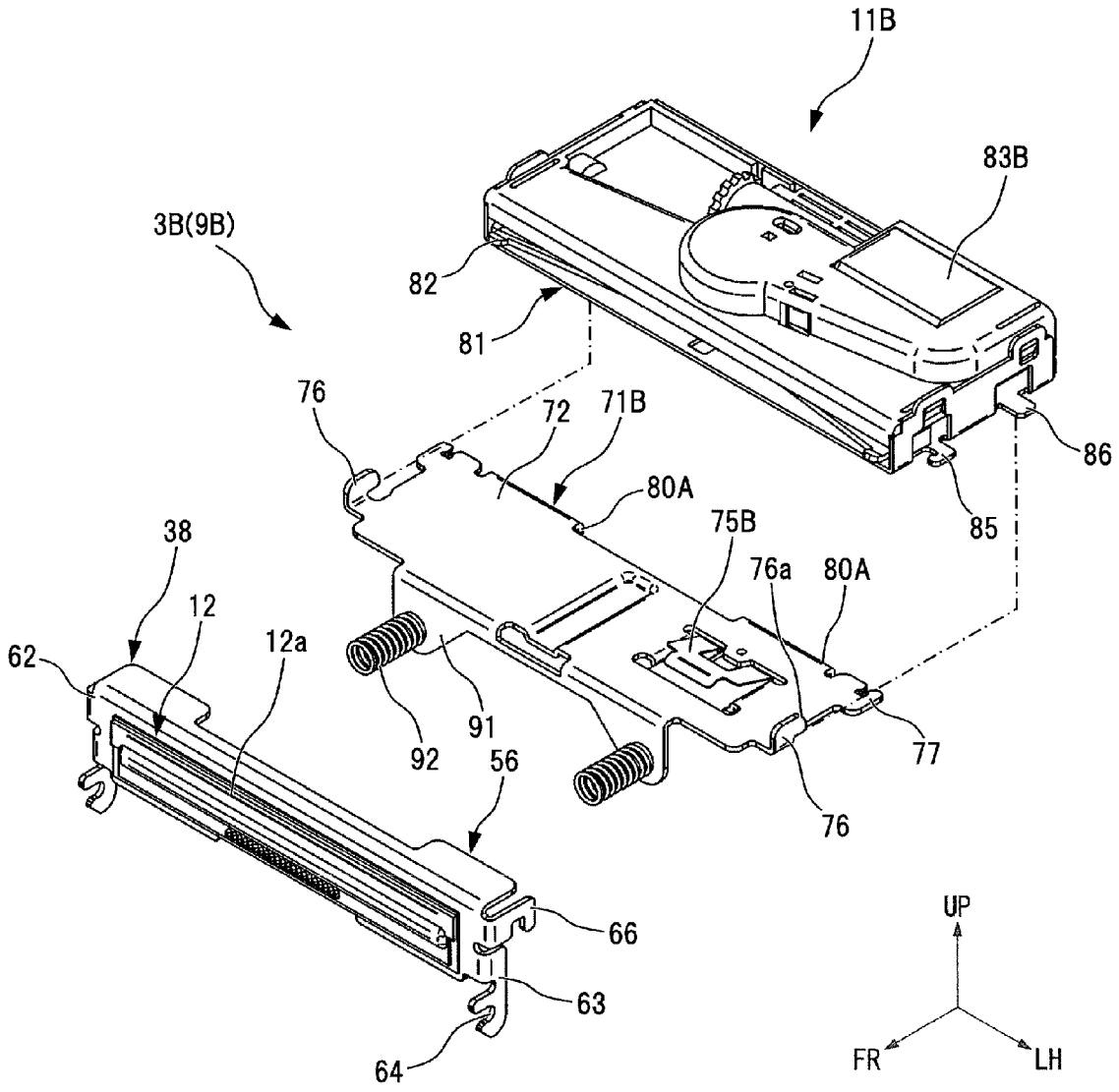
FIG. 20 is an exploded perspective view of the head block, the movable blade, and the support member, for illustrating the modified example of the printing unit according to another embodiment.
Figure 21:
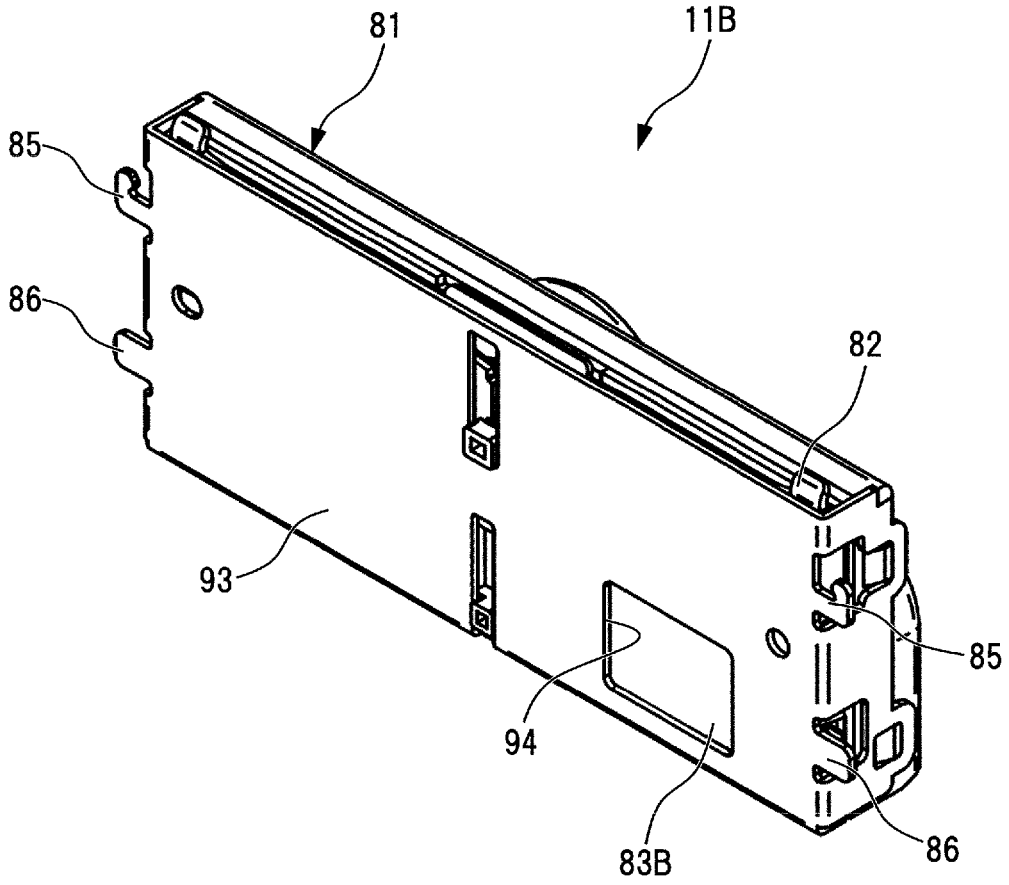
FIG. 21 is a perspective view of the movable blade in FIG. 20 as viewed from a bottom surface thereof.
Figure 22:
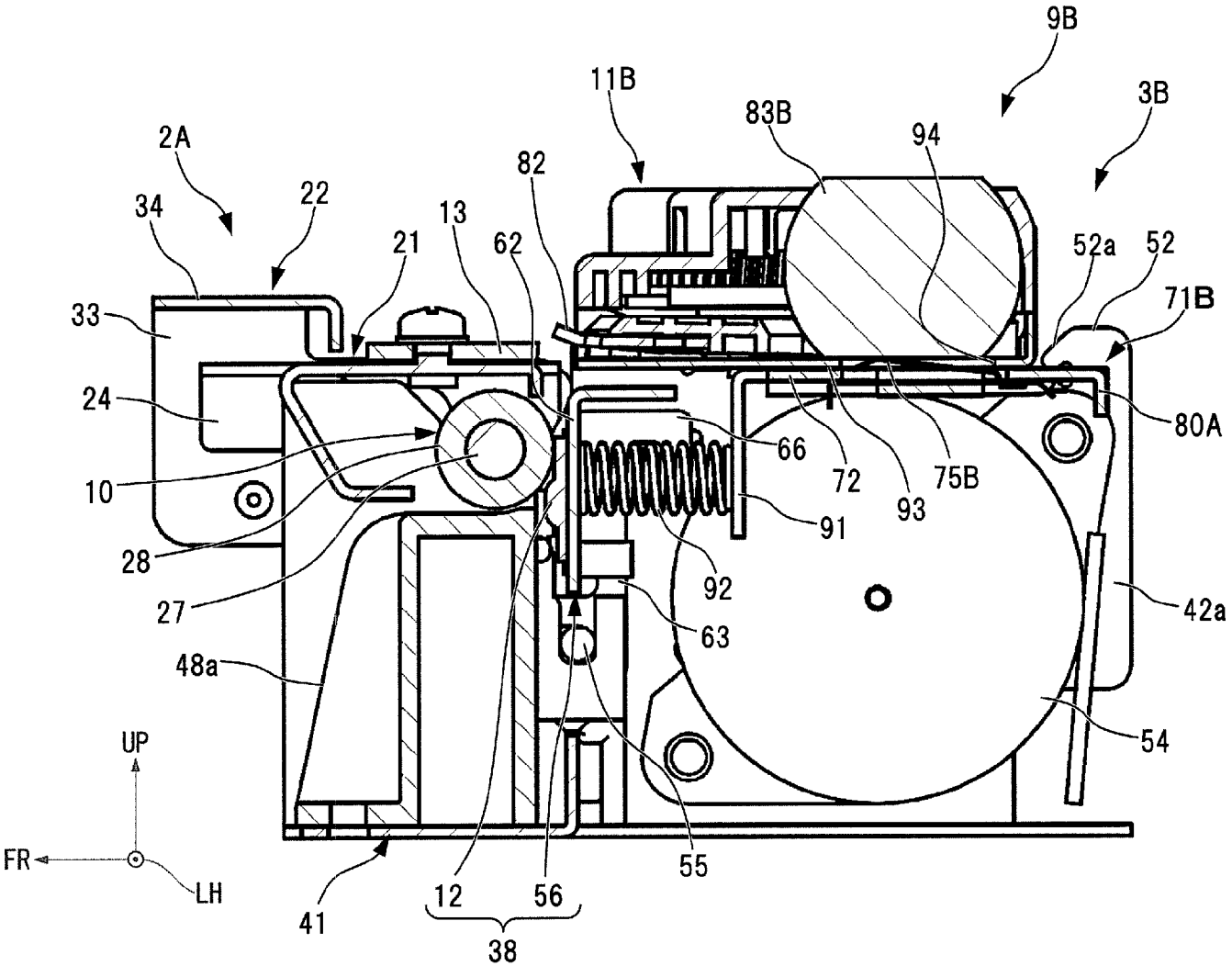
FIG. 22 is a sectional view taken along the line B-B in FIG. 19, for illustrating the modified example of the printing unit according to another embodiment.

Next, a modified example of the above-mentioned another embodiment is described referring to the drawings. In the modified example, the same components as those of the above-mentioned embodiment are denoted by the same reference symbols, and description thereof is omitted herein. FIG. 19 is a perspective view for illustrating the modified example of the printing unit according to another embodiment. Further, FIG. 20 is an exploded perspective view for illustrating the head block of the modified example of the printing unit, the movable blade, and the support member. FIG. 21 is a perspective view of the movable blade in FIG. 20 as viewed from a bottom surface thereof. Further, FIG. 22 is a sectional view taken along the line B-B in FIG. 19, for illustrating the modified example of the printing unit.

A printing unit 9B of this embodiment includes the platen unit 2A and a head unit 3B, which are combined with each other separably. Further, the head unit 3B includes the head block 38 including the thermal head 12, a movable blade 11B, the head frame 41, and a support member 71B. The head frame 41 supports the head block 38 and the movable blade 11B in a removable manner. The support member 71B supports the head block 38 from the rear side, and couples the movable blade 11B to the head frame 41.

As illustrated in FIG. 21, similarly to the above-mentioned another embodiment, the movable blade 11B has the cutout portion 94 formed in the bottom surface 93 opposed to the support member 71B at the position located below a motor 83B for a movable blade. Further, as illustrated in FIG. 20, the support member 71B has a metallic plate spring 75B formed on the base portion 72 at a position corresponding to the cutout portion 94. Similarly to the above-mentioned movable-blade urging members (second urging members) 75, the plate spring 75B urges upward the movable blade 11B when the movable blade 11B is mounted to the support member 71B. With this, when the support member 71B is located at the decoupled position, the movable blade 11B can be automatically detached from the support member 71B.

Further, also in the head unit 3B according to the modified example, similarly to the above-mentioned another embodiment, when the movable blade 11B is mounted to the support member 71B, the metallic plate spring 75B is provided under a state in which the metallic plate spring 75B comes into contact with the support member 71B formed of a metal material and the motor 83B for a movable blade. With this, electrical conduction of the motor 83B for a movable blade is ensured. Therefore, the reliability of the motor for a movable blade can be enhanced without additionally providing a new member.

Besides the above, the components in the above-mentioned embodiments may be replaced by well-known components as appropriate without departing from the gist of the present invention. The above-mentioned modified examples may be combined with each other as appropriate.

What is claimed is:

1. A printing unit, comprising:

a platen unit including a platen roller configured to feed a recording sheet; and a head unit including a thermal head configured to perform printing on the recording sheet, the head unit being separably combined with the platen unit, the head unit including:

a head frame;

a cutter mechanism mounted to the head frame in a removable manner, the cutter mechanism being configured to cut the recording sheet;

a support member mounted on the head frame and located between the cutter mechanism and the head frame, the support member being movable between a coupled position at which the cutter mechanism is coupled to the head frame and a decoupled position at which the cutter mechanism is detachable from the head frame; and a first urging member interposed between the thermal head and the support member, the first urging member being configured to urge the thermal head toward the platen roller, and to urge the support member toward the coupled position.

2. A printing unit according to claim 1, wherein the thermal head is mounted to the head frame in a removable manner.

3. A printing unit according to claim 1, wherein the cutter mechanism includes:

a support member fixing piece, which is locked to the support member when the support member is located at the coupled position; and a frame fixing piece, which is inserted into the head frame.

4. A printing unit according to claim 1, further comprising:

a second urging member configured to urge the cutter mechanism in a direction of detaching the cutter mechanism from the head frame.

5. A printing unit according to claim 4, wherein the support member is formed of a metal material, the cutter mechanism includes a motor configured to drive a movable blade, at least a part of the motor is exposed from a surface of the cutter mechanism, which is opposed to the support member, and the second urging member is formed of a conductive material, and is provided under a state in which the second urging member comes into contact with the support member and the motor.

6. A printer comprising:

the printing unit according to claim 1; and a casing having the printing unit assembled therein.

7. A printing unit comprising:

a platen unit including a platen roller configured to feed a recording sheet; and a head unit including a thermal head configured to perform printing on the recording sheet, the head unit being separably combined with the platen unit, the head unit including:

a head frame;

a cutter mechanism mounted to the head frame in a removable manner, the cutter mechanism being configured to cut the recording sheet;

a support member between the cutter mechanism and the head frame, the support member being movable between a coupled position at which the cutter mechanism is coupled to the head frame and a decoupled position at which the cutter mechanism is detachable from the head frame; and a first urging member interposed between the thermal head and the support member, the first urging member being configured to urge the thermal head toward the platen roller, and to urge the support member toward the coupled position, the support member is slidable along an urging direction of the first urging member.

* * * * *